US008025982B2

(12) United States Patent
Futamura et al.

(10) Patent No.: US 8,025,982 B2
(45) Date of Patent: Sep. 27, 2011

(54) HIGH-STRENGTH HOT DIP GALVANNEALED STEEL SHEET HAVING HIGH POWDERING RESISTANCE AND METHOD FOR PRODUCING THE SAME

(75) Inventors: Yuichi Futamura, Kakogawa (JP); Michitaka Tsunezawa, Kakogawa (JP); Masaaki Miura, Kakogawa (JP); Hiroshi Irie, Kakogawa (JP); Takatoshi Yoshida, Kakogawa (JP); Masafumi Shimizu, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 263 days.

(21) Appl. No.: 12/094,997

(22) PCT Filed: Dec. 1, 2006

(86) PCT No.: PCT/JP2006/324114

§ 371 (c)(1),
(2), (4) Date: May 27, 2008

(87) PCT Pub. No.: WO2007/066600

PCT Pub. Date: Jun. 14, 2007

(65) Prior Publication Data

US 2010/0003541 A1 Jan. 7, 2010

(30) Foreign Application Priority Data

Dec. 6, 2005 (JP) ..... 2005-352291

(51) Int. Cl.

| | |
|---|---|
| ***B32B 15/04*** | (2006.01) |
| ***B32B 15/18*** | (2006.01) |
| ***B32B 15/20*** | (2006.01) |
| ***B05D 1/18*** | (2006.01) |
| ***B05D 3/02*** | (2006.01) |
| ***C21D 1/70*** | (2006.01) |
| ***C21D 11/00*** | (2006.01) |

(52) U.S. Cl. ..... 428/659; 428/682; 428/683; 428/336; 148/503; 148/505; 148/537; 427/433

(58) Field of Classification Search ..... 428/650, 428/652, 653, 658, 659, 681, 682, 683, 684, 428/685, 332, 336

See application file for complete search history.

(56) References Cited

U.S. PATENT DOCUMENTS

2002/0081452 A1* 6/2002 Nakajima et al. ..... 428/659
2004/0258949 A1* 12/2004 Honda et al. ..... 428/659

FOREIGN PATENT DOCUMENTS

JP 5 33111 2/1993

(Continued)

OTHER PUBLICATIONS

Machine Translation, Tosaka, JP 2003-313636, Nov. 2003.*

(Continued)

*Primary Examiner* — Michael Lavilla

(74) *Attorney, Agent, or Firm* — Oblon, Spivak, McClelland, Maier & Neustadt, L.L.P.

(57) ABSTRACT

Disclosed is a high-strength hot dip galvannealed steel sheet having high powdering resistance produced by employing such a constitution that a Fe—Zn alloy plated layer is provided on at least one side of a basis steel sheet and a region in which Al (atomic %)/Zn (atomic %)≧0.10 is present in a thickness of 300 Å or more from the surface of the plated layer along the depth direction of the plated layer. Also disclosed is a hot dip galvannealed steel sheet whose formability is greatly improved by optionally specifying chemical composition and structure of the basis steel sheet.

20 Claims, 2 Drawing Sheets

FOREIGN PATENT DOCUMENTS

| | | |
|---|---|---|
| JP | 9 13147 | 1/1997 |
| JP | 2695259 | 9/1997 |
| JP | 2000 73183 | 3/2000 |
| JP | 2002 235160 | 8/2002 |
| JP | 2002 302753 | 10/2002 |
| JP | 2003 313636 | 11/2003 |
| JP | 2004 315960 | 11/2004 |
| JP | 2005 146301 | 6/2005 |
| JP | 2005 248240 | 9/2005 |

OTHER PUBLICATIONS

Machine Translation, Hori et al., JP 2000-073183, Mar. 2000.*
Machine Translation, Nakamori et al., JP 05-033111, Feb. 1993.*
U.S. Appl. No. 12/305,998, filed Dec. 22, 2008, Saito, et al.
U.S. Appl. No. 12/520,105, filed Jun. 19, 2009, Irie, et al.
U.S. Appl. No. 12/983,482, filed Jan. 3, 2011, Futamura.

* cited by examiner

HIGH-STRENGTH HOT DIP GALVANNEALED STEEL SHEET HAVING HIGH POWDERING RESISTANCE AND METHOD FOR PRODUCING THE SAME

TECHNICAL FIELD

The present invention relates to a high-strength hot dip galvannealed steel sheet having high powdering resistance and a useful method for producing such a steel plate, and in particular to a hot dip galvannealed steel sheet useful as a material for a structural member for automobiles and a method for producing the same.

BACKGROUND ART

Hot-dip galvannealed steel sheets (hereinafter sometimes abbreviated as "GA steel sheets") are obtained by heating hot dip galvanized steel sheets (GI steel sheets) to diffuse Fe in basis steel sheets into plated layers so that Fe and Zn are alloyed. Since GA steel sheets have excellent strength, weldability, corrosion resistance after being painted and other properties, it is used, for example, for a structural member (a member serving as an energy absorber during collision) of automobiles.

Such a GA steel sheet sometimes has the problem that the plated layer peels off in the form of powders during forming, which is called powdering. In recent years, improvement in tensile strength is required for steel sheet for automobiles for the purpose of improving fuel efficiency by reduction of body weight improving collision safety. Since this improvement intensile strength makes forming conditions severe during pressing, damage caused in the plated layer is further increased, causing powdering more easily.

An example of widely known methods for improving powdering resistance of a GA steel sheet is reducing the iron concentration in the Fe—Zn alloy plated layer to reduce the brittle Γ phase. In addition, for example, Japanese Patent No. 2695259 discloses powdering resistance and flaking resistance can be improved by adjusting the amounts of the ζ phase, δ1 phase and Γ phase in the plated layer and inhibiting formation of the Γ phase at the interface of the basis iron (basis steel sheet) to further limit the surface roughness to a low level. However, these means can only produce insufficient effect in improving powdering resistance on the plated layers in recent steel sheets having high tensile strength.

Japanese Published Unexamined Patent Application No. 2002-302753 discloses a hot dip galvannealed steel sheet excellent in press formability (sliding property during press molding) and chemical treatability having a flat portion in which an oxide layer having a thickness of 10 nm (100 Å) or more is formed on the surface of the plated layer and a Zn/Al ratio (atomic %) in the surface layer of the flat portion is 2.0 to 8.0. However, this cited invention only aims to improve the press formability and chemical treatability of the GA steel sheet, and does not consider powdering resistance.

Furthermore, in this cited invention, the thick "oxide layer" which has the function to improve press formability means "a layer comprising one or more oxides and/or hydroxides of Zn, Fe, Al and other metal elements". In contrast, the "Zn/Al ratio on the surface layer" in this cited invention is used as an index for unevenness on the surface layer of the oxide layer for imparting both press formability and chemical treatability. In the cited invention, this "Zn/Al ratio" is merely a value of the surface layer in the flat portion of the plated layer, and it is not thought that the entire "oxide layer", that is, even the deepest part of the oxide layer, has this ratio. In other word, although the cited invention considers the thickness of the "oxide layer", the thickness of the region having the specific "Zn/Al ratio" is not considered at all.

Incidentally, steel sheets for automobiles are often press-formed into complicated shapes. Therefore, GA steel sheets are further required to have excellent formability (elongation). However, increased strength in a steel sheet deteriorates formability, a steel sheet having both strength and formability (improvement in the balance of strength and ductility) is required.

For these reasons, TRIP steel sheets are attracting attention as basis steel sheets used for GA steel sheets: this TRIP steel sheet is manufactured by producing retained austenite (hereinafter sometimes referred to as "retained γ") in its structure and allowing this retained γ to undergo induced transformation (transformation induced plasticity "TRIP") during deformation in working, thereby producing excellent ductility. Typical examples of base phases of the TRIP steel sheets include polygonal ferrite and bainitic ferrite, as well as tempered martensite, tempered bainite and the like. In TRIP steel sheets, a base phase structure is introduced by adjusting a cooling rate after hot rolling or by other means; the steel sheet at a ferrite-austenite two-phase region temperature or austenite single-phase region temperature is cooled according to a specific pattern; and is then heated to and held at a predetermined temperature (austempering), whereby the retained γ is introduced.

Japanese Published Unexamined Patent Application No. 2002-235160 discloses a TRIP steel sheet which comprises polygonal ferrite and bainitic ferrite as the base phase structure. This document mainly discusses a GI steel sheet, and describes that the concentration of C (Cγ) in the retained γ greatly affects the characteristics of the TRIP steel sheet and the higher the amount of Cγ contained (for example, Cγ≧0.8%) the better the ductility such as elongation. However, this document does not specifically describe GA steel sheets.

Japanese Published Unexamined Patent Application No. 2005-146301 discloses a TRIP steel sheet comprising tempered martensite and ferrite as the base phase structure, and both GI steel sheets and GA steel sheets are shown as examples. This document describes that a preferred alloying temperature for the GA steel sheets is 450 to 600° C., but it does not refer to the concentration of C (Cγ) in the retained γ.

TRIP steel sheet utilizes an excellent ductility improving function by the retained γ. However, there is the disadvantage that the retained γ produced by austempering is transformed into cementite and ferrite if its alloying is not property performed and the amount of the retained γ in the GA steel sheet is reduced. That is, although excellent balance of strength and ductility is initially obtained due to production of the retained γ in the GI steel sheet, part of the retained γ disappears in the GI steel sheet in the process of alloying the GI steel sheet. Therefore, the GA steel sheet has the problem that a desired balance of strength and ductility is not effectively exhibited in some cases.

A technique for increasing the formability of a high-strength hot dip galvanized steel sheet is disclosed in Japanese Examined Patent Publication No. S62-40405, which discusses converting the metal structure of the steel sheet into a dual-phase ("DP") containing a low temperature transformation phase mainly consisting of a ferrite basis and martensite. However, the strength of the DP steel sheet disclosed in this document is about 600 MPa, but even higher strength is required.

Japanese Published Unexamined Patent Application No. H9-13147 also describes a high tensile strength hot dip galvannealed steel sheet with increased moldability and a strength of 800 MPa or more. This document describes that Si is added in an amount of 0.4% or more to enhance the strength of the steel sheet and also impart a dual phase structure of ferrite and martensite to the metal structure of the steel sheet. However, this document does not pay attention to the relationship between Si and the balance of strength and ductility, and the balance of strength and ductility is deteriorated in some cases.

The present invention was accomplished in such situations, and its primary object is to provide a high-strength hot dip galvannealed steel sheet having high powdering resistance (particularly a high tensile strength steel sheet). It is another object of the present invention to provide a high-strength hot dip galvannealed steel sheet which has excellent powdering resistance and exhibits excellent balance of strength and ductility, and a useful method for producing such a hot dip galvannealed steel sheet.

DISCLOSURE OF INVENTION

The hot dip galvannealed steel sheet of the present invention which achieved the above-mentioned objects has a Fe—Zn alloy plated layer on at least one side of the steel sheet, and a region in which Al (atomic %)/Zn (atomic %)≧0.10 is present in a thickness of 300 Å or more from the surface of the plated layer along the depth direction of the plated layer.

In the hot dip galvannealed steel sheet of the present invention, the surface layer of the plated layer is preferably a $\delta_1$ phase. In a preferred hot dip galvannealed steel sheet of the present invention, the plated layer contains Si-based oxide and contains Si in an amount of 0.1% by mass or more. Further, it is also preferable that the amount of Si contained in the basis steel sheet is 0.3 to 3.0% (meaning "% by mass", also for chemical composition of the basis steel sheet in the following).

In the above high-strength hot dip galvannealed steel sheet of the present invention, the basis steel sheet used comprises the following components: C: 0.05 to 0.3%, Si: 0.5 to 3.0%, Mn: 0.5 to 3.5%, P: 0.03% or less (not including 0%), S: 0.01% or less (not including 0%) and Al: 0.005 to 2.5%; satisfies Si+Al: 0.6 to 3.5%; comprises iron and inevitable impurities as the remainder; and has a steel structure of a composite phase steel sheet (TRIP steel sheet) comprising a base phase structure of ferrite and bainitic ferrite, and a second phase structure of retained austenite, whereby the steel sheet can have excellent powdering resistance and exhibit excellent balance of strength and ductility.

Moreover, the steel structure in the composite phase steel sheet (TRIP steel sheet) used as the basis steel sheet is preferably a composite structure comprising ferrite: 90% by volume or less and bainitic ferrite: 90% by volume or less; having the total amount of ferrite and/or bainitic ferrite of 70% by volume or more; and comprising retained austenite: 5% by volume or more.

It is also possible to use as the basis steel sheet a composite phase steel sheet whose metal structure mainly consists of a mixed structure of ferrite and martensite (DP steel sheet) comprising the following components: C: 0.05 to 0.3%, Si: 0.5 to 3.0%, Mn: 1.0 to 3.0%, P: 0.03% or less (not including 0%), S: 0.01% or less (not including 0%), Al: 0.005 to 2.5%, and iron and inevitable impurities as the remainder.

In producing a high-strength hot dip galvannealed steel sheet in which the structure of the TRIP steel sheet as the basis steel sheet is defined as mentioned above, the carbon concentration (Cγ) in the retained austenite in the hot dip galvanized steel sheet before being alloyed may be controlled to meet equation (1) shown below, depending on an alloying temperature (Tga).

$$-0.0030\times Tga+2.42 \leqq C\gamma \leqq -0.0030\times Tga+2.72 \quad (1)$$

however, 450≦Tga≦550, wherein Tga represents the alloying temperature (° C.); and Cγ represents the carbon concentration (%) in the retained austenite in the hot dip galvanized steel sheet before being alloyed.

The DP steel sheet for use in the present invention is a composite phase steel sheet whose metal structure mainly consists of a mixed structure of ferrite and martensite. In this composite structure, it is preferable that the following conditions are met: ferrite: 5 to 90% by volume, martensite: 5 to 90% by volume; the total amount of ferrite and martensite: 70% by volume or more; and the retained austenite: 10% by volume or less.

In the high-strength hot dip galvannealed steel sheet of the present invention, the basis steel sheet used (TRIP steel sheet and DP steel sheet) may also comprise the following components as other elements: (a) Cr: 1% or less (not including 0%) and/or Mo: 1% or less (not including 0%), (b) one or more members selected from the group consisting of Ti: 0.2% or less (not including 0%), Nb: 0.2% or less (not including 0%) and V: 0.3% or less (not including 0%), (c) Cu: 3% or less (not including 0%) and/or Ni: 3% or less (not including 0%), (d) B: 0.01% or less (not including 0%), (e) Ca: 0.01% or less (not including 0%), among other components. Such a basis steel sheet is also useful. The characteristics of the basis steel sheet (that is, high-strength hot dip galvannealed steel sheet) are further improved depending on added components.

In the above DP steel sheet, it is preferable that when Cr: 1% or less (not including 0%) and/or Mo: 1% or less (not including 0%) is/are contained as other elements, the amount of Si contained in the basis steel sheet satisfies equation (2) shown below.

$$\alpha-4.1 \leqq [Si] \leqq \alpha-2.4 \quad (2)$$

however, $$\alpha=6.9\times([C]+[Mn]/6+[Cr]/5+[Mo]/4)^{1/2},$$

wherein [ ] represents the amount (% by mass) of each element contained in the steel sheet.

When the DP steel sheet contains, as the other elements, one or more members selected from the group consisting of Cr: 1% or less (not including 0%) and Mo: 1% or less (not including 0%), Ti: 0.2% or less (not including 0%), Nb: 0.2% or less (not including 0%) and V: 0.3% or less (not including 0%), it is preferable that the amount of Si contained in the basis steel sheet satisfies equation (3) shown below.

$$\beta-4.1 \leqq [Si] \leqq \beta-2.4 \quad (3)$$

however, $$\beta=6.9\times([C]+[Mn]/6+[Cr]/5+[Mo]/4+[Ti]/15+[Nb]/17+[V]/14)^{1/2},$$

wherein [ ] represents the amount (% by mass) of each element contained in the steel sheet.

BEST MODE FOR CARRYING OUT THE INVENTION

Figure 1:
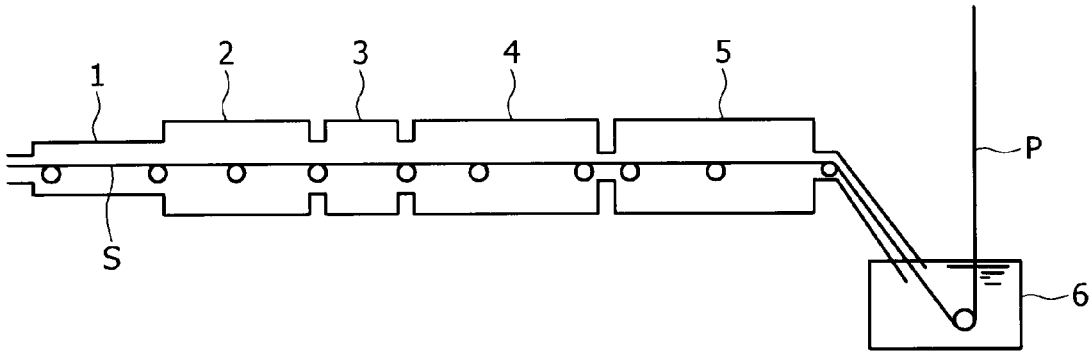
FIG. 1 is a schematic diagram showing one aspect of a hot dip galvanizing equipment for producing the hot dip galvannealed steel sheet of the present invention (GA steel sheet).

The gist of the GA steel sheet of the present invention lies in that a region in which Al (atomic %)/Zn (atomic %)≧0.10 is present in a thickness of 300 Å or more from the surface of the plated layer along the depth direction of the plated layer. The thickness of the Al concentrated surface layer region is preferably 400 Å or more, and more preferably 500 Å or more, from the standpoint of powdering resistance. The thicker the Al concentrated surface layer region, the better from the standpoint of powdering resistance, but if it is too thick, the chemical treatability, weldability and other properties of the plated steel sheet may be lowered. Therefore, the thickness of this region is preferably 1500 Å or less, and more preferably 1000 Å or less.

Similarly, considering powdering resistance and chemical treatability, Al (atomic %)/Zn (atomic %) is preferably 0.15 or more, and more preferably 0.20 or more, but preferably 0.40 or less, and more preferably 0.30 or less.

The GA steel sheet of the present invention has a Fe—Zn alloy plated layer having the Al concentrated surface layer region having a thickness of 300 Å or more on one side of the basis steel sheet at least. In the present invention, the amount of plating is not particularly limited. However, the less the amount of plating, the clearer the difference in powdering resistance between the plated steel sheet having the thick Al concentrated surface layer region and a steel sheet without such a region. Meanwhile, if the amount of plating is too small, corrosion resistance becomes insufficient. From such a standpoint, the amount of plating is preferably 20 g/m$^2$ or more, and more preferably 40 g/m$^2$ or more, but preferably 80 g/m$^2$ or less, and more preferably 60 g/m$^2$ or less.

The mechanism that powdering resistance is improved by thickening the Al concentrated surface layer region is not exactly known, but can be presumed as below. However, the present invention is not limited to the presumed mechanism below.

Since Al-based oxides are hard, the presence of a thick layer of these oxides on the surface layer lowers sliding resistance during forming and the shearing stress exerted on the plated layer. As a result, peeling of the plating (powdering) is presumably suppressed. Even if cracks occur, which are the cause of powdering, the cracks spread mainly in the Al concentrated surface layer region containing the hard Al-based oxide, and its spreading in the direction of the depth of the plated layer is mitigated. Accordingly, peeling of the plating from the interface between the plated layer and the basis steel sheet is presumably suppressed.

The GA steel sheet of the present invention in which the thickness of the Al concentrated surface layer region is 300 Å or more can be manufactured by the following procedure of controlling oxidizing and reducing conditions: First, the surface of the steel sheet is heated and oxidized in an oxidizing zone. Second, this is annealed for reduction in a reducing zone and then immersed in a Zn plating bath (hereinafter sometimes abbreviated as "oxidation reduction plating method). From the standpoint of productivity, it is preferable to perform the oxidation reduction plating method in a continuous galvanizing line (CGL).

When the oxidation reduction plating method is employed, a porous Fe layer having a large surface area occurs on the surface of the steel sheet. Such a steel sheet in which a thick porous Fe layer is formed has a large surface area and therefore actively reacts with Al which is present in the Zn plating bath only in an amount of about 0.1% by mass, whereby a Fe—Al-based intermetallic compound can be formed in a great amount. As a result, a large amount of Al is incorporated into the plated layer and this large amount of Al is concentrated and oxidized on the surface in the hardening process of plating. Therefore, the GA steel sheet having the thick Al concentrated surface layer region can be produced.

One may consider increasing the amount of Al in the Zn plating bath to simply incorporate a large amount of Al. However, this is not desirable because increasing the amount of Al in the Zn plating bath increases the thickness of the Fe—Al-based intermetallic compound at the interface between the plated layer and the basis steel sheet, and this acts as a barrier layer which prevents Fe—Zn alloying after plating.

Thus, to form a thin Fe—Al-based intermetallic compound in a great amount and the thick Al concentrated surface layer region while avoiding formation of the thick Fe—Al-based intermetallic compound which adversely affects as a barrier layer in alloying, it is preferable that the amount of Al in the Zn plating bath is maintained to be about 0.1% by mass and simultaneously allow a porous and thick Fe layer to form by controlling oxidizing and reducing conditions. To achieve this, a thick layer of Fe-based oxide needs to be formed in the oxidation step. Specifically, it is preferable that a Fe-based oxide layer having a thickness of 3000 Å or more is formed.

To form such a thick Fe-based oxide layer by the oxidation reduction plating method in the CGL, it is preferable that flames are directly blown onto the steel sheet in an oxidizing furnace (OF) to allow oxidation to occur rapidly. The thick Fe-based oxide layer can be also formed by a method which is typically used in conventional CGL: oxidation is performed in a non-oxidizing furnace (NOF) in a mildly oxidizing atmosphere in which the air-fuel ratio is limited to a low level. Specifically, if the length of the NOF is increased or the line speed is decreased, the residence time of the steel sheet in the NOF which is an oxidizing zone is extended so that the thick Fe-based oxide layer is supposedly formed. However, considering productivity, elongating the NOF or decreasing the line speed to such an extent that the Fe-based oxide layer having a thickness of 3000 Å or more is formed is difficult in fact.

Flames are blown preferably directly by a stationary burner with its nozzle directed towards the top surface and bottom surface of the steel sheet, in particular by a slit burner extending in the width direction of the steel sheet. The growth rate of the Fe-based oxide layer (the rate that the thickness of the layer increases per second) when the steel sheet is passed through the oxidizing region of the flames is preferably adjusted to 200 to 2000 Å/sec. If the growth rate is lower than 200 Å/sec., the Fe-based oxide layer having a sufficient thickness cannot be promptly formed. On the other hand, if the rate is higher than 2000 Å/sec., controlling the thickness of the Fe-based oxide layer becomes difficult, and therefore a uniform layer may not be formed.

It is preferable that the basis steel sheet is heated to temperature of 600° C. or higher in a non-oxidizing zone or a reducing zone, specifically an NOF with a limited air-fuel ratio, prior to oxidation by blowing flames. If oxidation is performed by gradually increasing the temperature of the steel sheet, the Fe-based oxide layer grows gradually so that diffusion of oxygen is prevented. Therefore, oxidation is carried out after a high temperature is reached, whereby the Fe-based oxide layer can be promptly and thickly formed before diffusion of oxygen is inhibited. Oxidation in the OF is preferably performed under such heating conditions that the temperature of the steel sheet which is entering the OF is 600° C. or higher, and the temperature of the steel sheet which is taken out from the OF is 710° C. or higher.

When the steel sheet is oxidized by blowing flames by a burner, oxygen and/or water vapor, if necessary, is/are fed to the combustion air of the burner so that the growth rate of the Fe-based oxide layer can be improved. However, if oxygen and/or water vapor is/are excessively fed, their effects become saturated, and addition of these will require utility cost. Therefore, oxygen and water vapor are preferably fed at flow rates of 20% by volume or less of and 40% by volume or less, respectively, relative to the amount of the combustion air.

Furthermore, to allow the thick Fe-based oxide layer to form rapidly and uniformly, it is preferable that in the NOF, the steel sheet is heated under such conditions that $0.9 \leqq r1 < 1.00$ (r1 represents the air-fuel ratio in the NOF) and $450 \leqq t1 \leqq 1750 - 1000 \times r1$ (t1 represents a temperature (° C.) which the steel sheet in the NOF reaches) are met and then in the OF in which flames are blown, the steel sheet is oxidized under such a condition that $1.00 \leqq r2 \leqq 1.35$ (r2 represents the air-fuel ratio in the OF) is met.

One aspect of a preferred CGL for producing the GA steel sheet of the present invention is, for example, the one shown in FIG. 1. First, a basis steel sheet S is heated in a pre-heating apparatus 1 and then in a non-oxidizing furnace (NOF) 2. Flames are blown onto the steel sheet in an oxidizing furnace (OF) 3 to allow a Fe-based oxide layer to form. This Fe-based oxide layer is subjected to reduction in a reducing annealing furnace (RF) 4 which corresponds to a reducing zone so that the Fe-based oxide layer becomes a porous Fe layer having a high specific surface area. Second, the steel sheet is cooled by a cooling apparatus 5, and is then immersed into a Zn plating bath in a hot dip galvanizing apparatus 6, thereby giving a hot dip galvanized steel sheet P. By heating this hot dip galvanized steel sheet P in an alloying furnace (not shown), the plated layer can be alloyed to produce a hot dip galvannealed steel sheet (GA steel sheet). To obtain the GA steel sheet of the present invention, the conditions described above in detail are important to allow the thick Fe-based oxide layer to form, and the other CGL conditions can be those commonly employed in this technical field.

A preferable GA steel sheet of the present invention is such that its surface layer of the plated layer is the $\delta_1$ phase, and there is substantially no $\zeta$ phase. If the $\zeta$ phase which is softer than the $\delta_1$ phase is present on the surface layer, the effects produced by the hardness of the Al-based oxide are relatively impaired because of the soft $\zeta$ phase. Consequently, it is presumed that the function to reduce sliding resistance during forming due to the hardness of the Al concentrated surface layer region and cracks spread mainly through the hard Al concentrated surface layer region, whereby the function to mitigate spreading of cracks in the depth direction is also relatively impaired.

To constitute the surface layer of the plated layer only by the $\delta_1$ phase substantially having no $\zeta$ phase, alloying of the plated layer can be promoted to increase the amount of Fe in the Fe—Zn alloy plated layer. It is also effective to reduce the Fe concentration gradient in the plated layer. A specific example of the means to achieve this is to use a Si-containing steel sheet and increase its alloying temperature. In alloying of the plating of the Si-containing steel sheet at a high temperature, diffusion of Fe from a lower plated layer to an upper layer is quicker than in the diffusion of Fe from the basis steel sheet to the plated layer. Therefore, the Fe concentration gradient in the plated layer becomes lower.

A preferable GA steel sheet of the present invention comprises Si-based oxide present in the plated layer since such a steel sheet shows better powdering resistance. Although the mechanism how Si-based oxide improves powdering resistance is unknown, a probable reason is as follows: Since Si-based oxide is hard, lowering of sliding resistance during forming and spreading of cracks which occur during forming are stopped at Si-based oxide, as Al-based oxide, and thereby peeling of the plated layer is inhibited.

The amount of Si contained in the plated layer which can form Si-based oxide is desirably high from the standpoint of powdering resistance. However, if the amount of Si contained in the plated layer is too high, the powdering resistance improving effect will be saturated, and an attempt to increase the amount of Si contained may adversely affect plating wettability since the Si concentration on the surface of the basis steel sheet increases. Thus, the amount of Si contained in the plated layer is preferably 0.1% by mass or more, more preferably 0.2% by mass or more, and still more preferably 0.3% by mass or more, but is preferably 0.8% by mass or less, more preferably 0.6% by mass or less, and still more preferably 0.4% by mass or less.

In order that the hot dip galvannealed layer contains Si-based oxide and contains Si in an amount of 0.1% by mass or more, a Si-containing steel sheet, preferably a steel sheet containing Si in an amount of 0.3 to 3.0% or more can be plated by the oxidation reduction plating method and then alloyed. In the oxidation and reduction plating method, Si-based oxide is formed first by oxidation. This oxide is not reduced in a reducing atmosphere of about $N_2$-15% by volume $H_2$ normally employed in the oxidation and reduction plating method, and remains as Si-based oxide in the steel sheet. This Si-based oxide diffuses from the basis steel sheet to the plated layer during alloying. Thus, when the oxidation reduction plating method is performed under normal conditions and then alloying is performed, it is presumed that Si contained in the plated layer is all present in the form of oxide.

If the Fe-based oxide layer is formed too thickly by the oxidation and reduction plating method, the amount of Si tends to be lowered. Thus, to allow Si-based oxide to be present in the plated layer, it is preferably that the Fe-based oxide layer is controlled not to be too thick. To ensure a sufficient amount of Si in the plated layer, it is recommended that the thickness of the Fe-based oxide layer is adjusted to preferably 13000 Å or less, and more preferably 10000 Å or less. This can be achieved by, for example, restricting the air-fuel ratio of the OF, the steel sheet temperature or by other means. Furthermore, Si-based oxide is not reduced in a reducing atmosphere in the normal oxidation reduction method but is rather oxidized. Therefore, Si-based oxide can be concentrated on the surface (selective oxidation) by increasing the reducing temperature. As a result, the amount of Si contained in the plated layer can be also increased.

The gist of the present invention lies in the structure of the plated layer, and the basis steel sheet which is subjected to plating is not particularly limited. However, because of the demand for higher tensile strength in recent years, a high tensile strength steel sheet is preferably used. Moreover, the use of the TRIP steel sheet and DP steel sheet described later as the basis steel sheet is preferable because a GA steel sheet having excellent balance of strength and ductility can be obtained.

In the GA steel sheet, to effectively allow the characteristics of the TRIP steel sheet to be exhibited, it is necessary that the retained γ derived from the hot dip galvanized steel sheet (Gl steel sheet) remains as it is without transforming into cementite and ferrite and disappearing. However, as already mentioned, the retained γ produced by austempering transforms into cementite and ferrite if its alloying is not property performed, and the amount of the retained γ in the GA steel sheet is reduced. Therefore, there is the disadvantage that a desired balance of strength and ductility is not effectively exhibited in the GA steel sheet.

In the present situation, TRIP steel sheets have been studied focusing mainly on Gl steel sheets, and the characteristics of the GA steel sheets which are obtained by alloying Gl steel sheets have not been sufficiently studied. In such a situation, the inventors of the present invention have conducted analysis especially from the standpoint of providing a method which can manufacture a GA steel sheet capable of exhibiting the highest possible balance of strength and ductility depending on an alloying temperature. As a result, the inventors found that if the carbon concentration (Cγ) in the retained γ in the hot dip galvanized steel sheet before being alloyed is controlled to meet the relationship in the above equation (1) depending on an alloying temperature (Tga), the desired objects can be achieved. Since its technical meanings are recognized, they have filed another application on the invention (Japanese Patent Application No. 2006-160834).

The process how the above invention was completed will be described. The inventors of the present invention first focused on the carbon concentration (Cγ) in the retained γ which contributes to the improvement of ductility such as elongation. As mentioned above, in the Gl steel sheet, the more the Cγ in the retained γ in the steel sheet, the more the retained γ is stabilized, so that the ductility is increased and the balance of strength and ductility is improved. In this regard, the GA steel sheet is the same: the more the Cγ in the retained γ after alloying, the better the balance of strength and ductility. However, it was first revealed in extensive basic experiments conducted by the inventors of the present invention that as for the Cγ in the retained γ before being alloyed, the GA steel sheet shows a behavior different from that of the GI steel sheet: In the GA steel sheet, when the amount of the Cγ in the retained γ before being alloyed is too high or too low, good balance of strength and ductility cannot be ensured.

As a result of the extensive experiments conducted by the inventors of the present invention, they found that there is an appropriate range (optimal range) of the amount of Cγ in which the highest possible balance of strength and ductility can be produced in the GA steel sheet, depending on an alloying temperature. This is, in the GI steel sheet, the higher the Cγ in the retained γ, the better the balance of strength and ductility. In contrast, it was revealed that in the GA steel sheet, an optimal range of the amount of Cγ in which the highest possible balance of strength and ductility can be exhibited exists depending on the alloying temperature, and the balance of strength and ductility is worsened when the amount of Cγ is higher or lower than the optimal range. It was also found that in the GA steel sheet, there is a trend that as the alloying temperature becomes higher, as 475° C., 500° C. and 525° C., the optimal range of the amount of Cγ is lowered. From such findings, it was found that in order to realize the highest possible balance of strength and ductility, the optimal range of the amount of Cγ is set to be low when an alloying temperature is high, while the optimal range of the amount of Cγ is set to be high when an alloying temperature is low.

Based on various experiment results, the inventors of the present invention have conducted further analysis. As a result, they found that the highest possible balance of strength and ductility corresponding to the alloying temperature is achieved by controlling, depending on an alloying temperature (Tga), so that the carbon concentration (Cγ) in the retained γ in the hot dip galvanized steel sheet before being alloyed meets the relationship of equation (1) shown below.

$$-0.0030\times Tga+2.42 \leqq C\gamma \leqq -0.0030\times Tga+2.72 \quad (1)$$ however, $$450 \leqq Tga \leqq 550$$

The above equation (1) will be described in detail. Briefly speaking, the above equation (1) defines that Cγ is set to be low when the alloying temperature (Tga) is high, while Cγ is set to be high when the alloying temperature (Tga) is low. If Cγ and Tga are appropriately controlled according to the above equation (1), the GA steel sheet which can exhibit the highest possible balance of strength and ductility corresponding to the alloying temperature can be provided.

Herein, the alloying temperature (Tga) is closely related to the characteristics (transformation of the retained γ, and concentration of C in the retained γ) of the retained γ. That is, the higher the alloying temperature, the more the transformation of the retained γ is promoted and the transformation into cementite and ferrite is likely to occur. Moreover, concentration of C in the retained γ is also promoted. On the other hand, the lower the alloying temperature, the more difficult for the transformation of the retained γ to occur. This trend is also found even when the Cγ in the retained γ is high.

The above equation (1) utilizes such a relationship between the characteristics of the retained γ and the alloying temperature. That is, when the alloying temperature is high, the transformation of the retained γ into cementite and ferrite can be suppressed by controlling Cγ to be low according to the above equation (1). The retained γ is allowed to be present in a large amount after galvannealing by suppressing the amount of Cγ in this manner.

On the other hand, when an alloying temperature is low, it is effective to control Cγ to be higher than in the case where an alloying temperature is high according to the above equation (1) so that a large amount of stable retained γ is allowed to be present in the GA steel sheet. The stable retained γ containing a large amount of Cγ can be allowed to be present after galvannealing by increasing Cγ in advance in this manner.

Therefore, by appropriately controlling the Cγ in the retained γ based on the above equation (1), the highest possible balance of strength and ductility corresponding to an alloying temperature can be realized.

Meanwhile, when the Cγ in the retained γ immediately before galvannealing does not does not fall with the range of the above equation (1), it has the problem described below. For the sake of explanation, the value calculated at the left-hand side of the above equation (1) may be referred to as a Q value, while the value calculated at the right-handed side of the above equation (1) may be referred to as an R value.

First, the case where Cγ in the retained γ in the basis steel sheet immediately before alloying is lower than the value (Q value) of the left-hand side of the above equation (1) will be considered. In this case, since Cγ (low Cγ) immediately before alloying is succeeded as it is after alloying, and therefore the retained γ with low Cγ occurs in the GA steel sheet, as in the GI steel sheet.

Second, the case where the Cγ in the retained γ immediately before alloying is higher than the value (R value) of the right-handed side of the above equation (1) will be considered. In this case, the retained γis transformed into cementite and ferrite in the process of alloying since Cγ is too high. Therefore, the retained γ with low Cγ occurs in the GA steel sheet, as in the GI steel sheet.

Therefore, only when the Cγ in the retained γ immediately before alloying falls within the range of the above equation (1), the retained γ which hardly transforms into cementite and ferrite even after alloying and containing Cγ (Cγ derived from the GI) as high as immediately before alloying is succeeded substantially can be ensured.

According to the analysis conducted by the inventors of the present invention, those in which Cγ falls with the range of the above equation (1) all have greatly improved balance of strength and ductility than those in which Cγ does not fall within the range of the above equation (1) (refer to Example 2 below). More specifically, the values of the balance of strength and ductility (tensile strength: TS×elongation: El) in the GA steel sheets which meet the requirements defined by the present invention are all higher by about 2.5 GPa·% or more than the minimum values of (TS×El) in those which do not meet the requirements defined by the present invention.

More specifically, Cγ immediately before alloying may be controlled to meet the following conditions, depending on the alloying temperature (Tga):

When $Tga=450°$ C., $1.07\% \leqq C\gamma \leqq 1.37\%$

When $Tga=475°$ C., $0.995\% \leqq C\gamma \leqq 1.295\%$

When $Tga=500°$ C., $0.92\% \leqq C\gamma \leqq 1.22\%$

When $Tga=550°$ C., $0.77\% \leqq C\gamma < 1.07\%$

Herein, as described later in detail, the Cγ in the retained γbefore being alloyed is determined by using the steel sheet which was rapidly cooled at an average cooling rate of about 10° C./sec. after performing hot dip galvanizing and before an alloying process is performed, by the X-ray diffraction.

Based on the findings mentioned above, in the present invention, the above equation (1) is defined.

In the present invention, the alloying temperature (Tga) when the basis steel sheet mentioned above is used is set within the range of 450 to 550°. This temperature range is set to obtain the GA steel sheet having retained γ. That is, when Tga is lower than 450° C., the hot dip galvanized layer cannot be alloyed. On the other hand, when Tga is higher than 550° C., the retained γ is transformed into cementite and ferrite.

In this manner, in the manufacturing method of the GA steel sheet according to the present invention, Cγ before being alloyed is controlled depending on an alloying temperature according to the above equation (1) on the precondition that the alloying temperature is in the range of 450 to 550° C. In carrying out the present invention method, as described in detail below, the lower limit of the alloying temperature (temperature for alloying hot dip galvanized layer) may be appropriately set depending on the type of the steel.

Second, the method for controlling Cγ will be specifically described. It is known that Cγ changes, for example, depending on the components in the steel, cooling conditions from a ferrite-austenite two-phase region temperature to an austempering temperature region, austempering conditions and others. Herein, it is preferable to keep the requirements (type of steel, cooling conditions, etc.) other than austempering conditions constant, examine and prepare in advance a change in the amount of Cγ when the austempering temperature and austempering time are varied (preliminary data showing the relationship between the austempering condition and the amount of Cγ), and suitably select austempering conditions for obtaining a predetermined amount of Cγ based on this preliminary data. Austempering is normally carried out at a temperature (austempering temperature) of about 300 to 500° C. for about 20 to 1000 seconds (austempering time). This allows the function of the retained γ to improve ductility to be effectively exhibited. Therefore, the above-mentioned preliminary data may be prepared by varying the austempering temperature and austempering time within the above-mentioned ranges.

A preferable TRIP steel sheet which can be used as the basis steel sheet in the present invention comprises the following chemical components: C: 0.05 to 0.3%, Si: 0.5 to 3.0%, Mn: 0.5 to 3.5%, P: 0.03% or less (not including 0%), S: 0.01% or less (not including 0%) and Al: 0.005 to 2.5%; satisfies Si+Al: 0.6 to 3.5%; and comprise iron and inevitable impurities as the remainder. The reasons for limitation of these components are as follows:

[C: 0.05 to 0.3%]

C is an element necessary to ensure the strength (tensile strength TS) of the steel sheet to 550 MPa or more. It also stimulates the production of the retained γ in the steel sheet and affects its stability. For allowing such a function to be exhibited, the amount of C contained is preferably 0.05% or more, and more preferably 0.07% or more. However, if the amount of C contained is too high, weldability is lowered. Therefore, the amount is preferably 0.3% or less, and more preferably 0.25% or less.

[Si: 0.5 to 3.0%]

Si is an element which has high solid solution hardening ability and can increase strength without lowering ductility. Moreover, it also promotes concentration of C in austenite, and effectively allows austenite to remain at room temperature to ensure excellent balance of strength and ductility. For allowing such a function to be exhibited, the amount of Si contained is preferably 0.5% or more, and more preferably 0.7% or more. However, if the amount of Si contained is excessively high, the strength becomes too high and therefore a rolling load is increased, and Si scales are generated in hot rolling to lower the surface property of the steel sheet. Therefore, it is preferably 3.0% or less, and more preferably 2.5% or less.

[Mn: 0.5 to 3.5%]

Mn is an element which is effective in ensuring the strength of the steel sheet. It is also an element which is effective in promoting production of the retained γ to increase formability. For allowing such a function to be exhibited, it is preferably contained in an amount of 0.5% or more, and more preferably 1.0% or more. However, if it is contained in an excessively high amount over 3.5%, ductility and weldability will be deteriorated. The amount is more preferably 3.0% or less.

[Al: 0.005 to 2.5%]

Al is preferably contained in an amount of at least 0.005% or more for the purpose of deoxidation. Moreover, Al is, as Si, an element which is effective in promoting concentration of C in austenite and allowing austenite to remain at room temperature to ensure excellent balance of strength and ductility. From the standpoint of allowing such function to be exhibited, it is preferably contained in an amount of 0.005% or more, and more preferably 0.01% or more. In contrast, when the amount of Al contained is too high, not only the function of ensuring the amount of the retained γ is saturated, but also the steel sheet becomes fragile and the production costs are increased. Therefore, the amount is preferably 2.5% or less, and more preferably 2.0% or less.

[Si+Al: 0.6 to 3.5%]

As mentioned above, Si and Al are both elements necessary for the production of retained austenite. For sufficiently ensuring the retained γ and allowing excellent formability to be exhibited stably, Si and Al are preferably contained in an amount of 0.6% or more, and more preferably 1.0% or more, as a total of the two. However, if the total amount of Si and Al contained is too high, not only the function to produce the retained γ is saturated, but also ductility is lowered and the steel becomes fragile. Therefore, the total amount should be 3.5% or less, and it is more preferably 3.0% or less.

[P: 0.03% or less (not including 0%)]

If P is contained in an excessive amount, weldability is deteriorated. Therefore, the amount is preferably limited to 0.03% or less.

[S: 0.01% or less (not including 0%)]

If S is contained in an excessive amount, sulfide inclusions are increased and the strength of the steel sheet is deteriorated. Therefore, the amount is preferably limited to 0.01% or less.

Preferable basic components of the TRIP steel sheet are as mentioned above, and the remainder is iron and inevitable impurities. Examples of inevitable impurities include N, O, tramp elements and the like (for example, Sn, As, Sb, etc.). Preferable ranges of N and O area as follows:

[N: 0.01% or less (not including 0%)]

N is an element which causes nitride to be deposited in the steel to strengthen the steel. If N is present in an excessive amount, nitride is deposited in a large amount and may cause deterioration of ductility instead. Therefore, the amount of N is preferably 0.01% or less.

[0: 0.01% or less (not including 0%)]

If O is contained in an excessive amount, inclusions are increased and may cause deterioration of ductility. Therefore, the amount of O is preferably 0.01% or less.

The basis steel sheet having the chemical components mentioned above may be used to manufacture a hot dip galvannealed steel sheet having a predetermined base phase structure and retained γ according to a conventional method. At that time, depending on the alloying temperature set in advance, the hot dip galvannealed steel sheet which can exhibit the highest possible balance of strength and ductility corresponding to the alloying temperature can be obtained by appropriately controlling Cγ before being alloyed based on the above equation (1).

Other conditions in producing the hot dip galvannealed steel sheet are not particularly limited. The base phase structure (ferrite and/or bainitic ferrite) is introduced by adjusting a cooling rate after hot rolling or by other means, the steel sheet is cooled from the ferrite-austenite two-phase region temperature by a specific pattern, and is then subjected to austempering, whereby the retained γ is introduced. More specifically, the steel having the above components are hot-rolled in the manner mentioned later so that a predetermined base phase structure and retained γ (described later) are obtained. The resulting sheet is wound up, and is then subjected to cold rolling, if necessary. Before the cold rolling, pickling may be carried out to remove scales formed on the surface of the steel sheet.

Preferable conditions for hot rolling are, for example, the following ranges: the heating temperature is about 1000 to 1300° C.; the finishing rolling temperature is about 800 to 950° C.; and the winding temperature is about 700° C. or less. The heating temperature is controlled to fall within the above-mentioned range from the standpoint of ensuring the finishing temperature and preventing austenite crystal grains from becoming coarse. The finishing temperature in hot rolling preferably falls within the above range so that a texture which inhibits formability is not formed. The winding temperature is controlled to be about 700° C. or lower since scales on the surface of the steel sheet become thick and pickling property is deteriorated if winding is performed at a temperature higher than this temperature. A cooling rate after finishing rolling is preferably controlled to fall within the range of about 30 to 120° C./sec. to inhibit the generation of pearlite.

The cold rolling is carried out to increase formability, if necessary. The cold rolling reduction at this time is preferably about 10% or more. If the cold rolling reduction is less than 10%, the hot-rolled sheet needs to be thinned and elongated to obtain a desired product, and the productivity during pickling is therefore lowered.

Next, the above steel sheet is heated to an austenite region (a temperature not lower than the Ac1 point). The heating condition may be appropriately controlled depending on the type of the base phase structure. For example, when a ferrite structure is produced, heating is preferably carried out at a temperature between about 800 and 840° C. for about 50 to 200 seconds. In contrast, when a bainitic ferrite structure is produced, heating is preferably carried out at a temperature between about 900 and 950° C. for about 50 to 200 seconds. The above-mentioned heat treatment may be performed in a continuous hot dip galvanizing line.

Subsequently, the above steel sheet is cooled at a cooling rate of about 2 to 100° C./sec. to an austempering temperature region (about 300 to 500° C.). When the cooling rate is lower than 2° C./sec., a large amount of pearlite is produced during cooling, and the volume fraction of austenite when the cooling is completed is significantly reduced. The cooling rate is preferably as high as possible to avoid pearlite transformation region, but if the cooling rate is too high, it is difficult to control the temperature when the cooling is completed. Therefore, its upper limit is preferably 100° C./sec.

As the cooling method, one of the easy methods is cooling to the austempering temperature region (single-stage cooling), but it is difficult to produce ferrite stably by the single-stage cooling. Therefore, the multiple-stage cooling method in which the cooling rate is dividedly set multiple times is preferably employed.

Subsequently, the steel sheet is heated and held at an austempering temperature (about 300 to 500° C.) for 20 to 1000 seconds (austempering). Accordingly, a predetermined amount of the retained γ is obtained. In the present invention, the austempering conditions may be appropriately controlled so that Cγ in the retained austenite before being alloyed meets the above equation (1), depending on the alloying temperature set in advance.

A hot dip galvanizing process is then performed. The temperature of the plating bath is about 400 to 500° C. (more preferably about 440 to 470° C.), and the steel sheet is preferably immersed in the bath for about 1 to 5 seconds. The ratio of constituents of the plating bath is not particularly limited. For example, the bath is preferably a hot dip galvanizing bath having an effective Al concentration of 0.07 to 0.13% by mass. Alloying is performed within 1 to 30 seconds after plating.

Alloying is performed by heating to a temperature between about 450 to 550° C. The alloying time is preferably controlled to fall within the range of about 5 to 30 seconds. A heating means in the alloying process is not particularly limited. For example, gas heating, induction heater heating and other commonly used means can be employed. Thereafter, the steel sheet is cooled to room temperature at an average cooling rate of about 1° C./sec. or higher.

The structure of the hot dip galvannealed steel sheet obtained in this manner is preferably controlled in the following manner:

Base phase structure: ferrite (F) and/or bainitic ferrite (BF)

Ferrite (meaning polygonal ferrite) and bainitic ferrite (BF) not only increase the strength of the steel sheet, but also contribute to improve elongation characteristic. BF means a lower structure (may or may not have a vitreous structure) having high dislocation density (initial dislocation density), and is different from F which is a lower structure having no or very low dislocation density. Since BF has a dislocation density higher than F, it has the features that it can readily achieve high strength and has high elongation characteristic and stretch-flanging performance. Among the above base phase structures, ferrite is a structure which contributes to ensure ductility, and bainitic ferrite is a structure which contributes to strength. From the standpoint of strength and ductility, it is recommended that these structures are maintained at an appropriate ratio by volume. From such a standpoint, ferrite and bainitic ferrite are preferably in the range of 90% by volume or less, respectively. In the present invention, the above-mentioned structures may be present singly, or may be mixed structures.

The space factor of the base phase structure may be 70% by volume or more, relative to the entire structures. The space factor is preferably 80% by volume or more, but it is recommended that its upper limit is controlled depending on the balance with the amount of the retained γ described later and adjusted appropriately so that desired high formability can be obtained.

Second phase structure: retained γ

The retained γ is a structure which improves the total elongation and further fatigue characteristics of the steel sheet. For allowing such a function to be effectively exhibited, it is preferably present in an amount of 5% or more by space factor (volume fraction), relative to the entire structures. The amount is more preferably 7% or more. However, if the retained γ is present in a large amount, not only the stretch-flanging performance is deteriorated, but also the carbon concentration in the retained austenite is lowered and the formability is lowered. Therefore, its upper limit is preferably about 25%. The carbon concentration in the retained γ greatly affects the improvement of ductility due to the transformation induced plasticity of the retained austenite during deformation in working. Accordingly, its average concentration is preferably 0.3% or more, and more preferably 0.5% or more. The amount of the retained γ can be determined by the saturation magnetization measuring method, as described later.

In the second phase structure, there may be further contained martensite as a different structure in addition to the retained γ insofar as they do not impair the operation of the present invention. Martensite can inevitably be retained in the course of production according to the present invention, but the smaller their amounts, the more preferable. It is recommended that the total amount thereof is preferably 20% or less by a space factor. It should be noted that pearlite is not included in the above different structures, and it is recommended to restrict pearlite to 10% or less at the most.

In the hot dip galvannealed steel sheet in which the steel sheet mentioned above is used as the basis steel sheet, the tensile strength (TS) of the basis steel sheet is 550 MPa or more, the balance of strength and ductility is good. Therefore, such characteristics are reflected so that the resulting hot dip galvannealed steel sheet also has a good balance of strength and ductility. Suitable applications of the hot dip galvannealed steel sheet is structural parts in automobiles, including frontal crash parts such as front and rear side members and crush boxes, pillars such as front and rear center pillar reinforce, structural components of vehicle body such as front and rear roof rails, side sills, floor members and kick parts, and impact absorption parts such as front and rear bumpers and door impact beams.

In the GA steel sheet of the present invention, a DP steel sheet having the constitution described below can be also used as the basis steel sheet which is subjected to plating from the standpoint of formability, so that a GA steel sheet having excellent balance of strength and ductility is achieved.

A DP steel sheet which is usable in the present invention contains Si in an amount range of 0.5 to 3.0%. Si is an element having high solid solution hardening ability, and functions to increase strength. When the amount of Si contained is increased, the fraction of ferrite is increased and bainite transformation of the low temperature transformation phases is inhibited so that a martensite structure becomes easy to obtain. Therefore, the metal structure of the steel sheet is rendered a composite structure of ferrite (meaning polygonal ferrite) and martensite, and high strength and good elongation (formability) are achieved. The amount of Si is 0.5% or more, preferably 0.6% or more, and more preferably 0.7% or more. However, if Si is excessively contained, Si scales are generated during hot rolling; the surface property of the steel sheet is deteriorated; and the chemical treatability and plating adherence of the steel sheet are lowered, thereby producing bare spots. If the amount of Si contained is excessive, it is difficult to obtain an austenite phase in annealing, and therefore it is difficult to obtain a mixed structure of ferrite and martensite. Thus, the amount of Si contained needs to be 3.0% or less, preferably 2.5% or less, and more preferably 2.3% or less.

The DP steel sheet which may be used in the present invention contains Si in an amount range of 0.5 to 3.0%. When it is used as the basis steel sheet in the present invention, it is also preferable to control the amount of Si contained depending on the amounts of the alloying elements contained which affect the generation of the martensite phase, among the alloying elements other than Si contained. The inventors of the present invention have prepared various steel sheets having different chemical components, and thoroughly analyzed the relationships between the chemical components and mechanical characteristics (that is, balance of strength and ductility) in the steel sheets. As a result, they found that the mechanical characteristics of the steel sheet can be improved by appropriately controlling the balance of the amount of Si contained in the steel and the amounts of the alloying elements contained which affect the generation of the martensite phase.

The alloying elements which affect the generation of the martensite phase are C, Mn, Cr, Mo, Ti, Nb and V. When the basis steel sheet does not contain at least one element selected from the group consisting of Ti, Nb and V (that is, when C, Mn, Cr and Mo are contained as basic components), it is preferable that the amount of Si contained in the steel satisfies equation (2) shown below. When the steel sheet contains at least one element selected from the group consisting of Ti, Nb and V, in addition to Cr and Mo, it is preferable that the amount of Si contained in the steel satisfies equation (3) shown below.

$$\alpha-4.1 \leqq [Si] \leqq \alpha-2.4 \quad (2)$$

$$\beta-4.1 \leqq [Si] \leqq \beta-2.4 \quad (3)$$

however, $$\alpha=6.9\times([C]+[Mn]/6+[Cr]/5+[Mo]/44)^{1/2}$$

$$\beta=6.9\times([C]+[Mn]/6+[Cr]/5+[Mo]/4+[Ti]/15+[Nb]/17+[V]/144)^{1/2},$$

wherein [ ] represents the amount (% by mass) of each element contained in the steel sheet.

The above C, Mn, Cr and Mo are elements which affect the generation of the martensite phase. If the amount of Si contained is low relative to the amount of C, Mn, Cr and Mo contained, the effects of adding Si are not exhibited, while on the other hand, if the amount of Si contained is excessive, the effects of adding Si is saturated. In both cases, the mechanical characteristics (balance of strength and ductility) tend to be deteriorated.

Moreover, among the low temperature transformation phases, the above Ti, Nb and V are elements which inhibit the generation of an intermediate transformation structure (for example, bainite and quasi-pearlite), and functions to produce the martensite phase. If the amount of Si contained is low relative to the amounts of Ti, Nb and V contained, the effects of adding Si are not exhibited, while on the other hand, if the amount of Si contained is excessive, the effects of adding Si is saturated. In both cases mechanical characteristics (balance of strength-elongation) tend to be deteriorated.

The lower limit of the above equation (2) is preferably equation (2a) shown below, and more preferably equation (2b) show below. Meanwhile, the upper limit of the above equation (2) is preferably equation (2c) shown below, and more preferably equation (2d) show below.

$$\alpha-4.0 \leqq [Si] \quad (2a)$$

$$\alpha-3.65 \leqq [Si] \quad (2b)$$

$$[Si] \leqq \alpha-2.55 \quad (2c)$$

$$[Si] \leqq \alpha-2.60 \quad (2d)$$

The lower limit of the above equation (3) is preferably equation (3a) shown below, and more preferably equation (3b) show below. Meanwhile, the upper limit of the above equation (3) is preferably equation (3c) shown below, and more preferably equation (3d) show below.

$$\beta-4.0 \leqq [Si] \quad (3a)$$

$$\beta-3.8 \leqq [Si] \quad (3b)$$

$$[Si] \leqq \beta-2.55 \quad (3c)$$

$$[Si] \leqq \beta-2.60 \quad (3d)$$

The DP steel sheet which may be used in the present invention contains C, Mn, P, S and Al as the basic elements other than Si. Appropriate ranges of the elements and the reasons for their limitation are as follows:

[C: 0.03 to 0.3%]

C is an element necessary to ensure the strength (tensile strength TS) of the steel sheet to 590 MPa or more, affects the generation and formation of the martensite phase of the steel sheet, affects elongation, and improves elongation. For allowing these effects to be exhibited, the amount of C contained needs to be 0.03% or more, and preferably 0.04% or more. However, if the amount of C contained is too high, weldability is lowered. Therefore, the amount needs to be 0.3% or less, and preferably 0.25% or less.

[Mn: 1.0 to 3.0%]

Mn is an element which is effective in ensuring the strength of the steel sheet. For allowing this effect to be exhibited, Mn needs to be contained in an amount of 1.0% or more, and preferably 1.5% or more. However, if it is contained in an excessively high amount over 3.0%, ductility (elongation) will be deteriorated. Therefore, the amount is preferably 2.8% or less.

[P: 0.03% or less (not including 0%)]

If P is contained in an excessive amount, weldability is deteriorated. Therefore, the amount needs to be restricted to 0.03% or less.

[S: 0.01% or less (not including 0%)]

If S is contained in an excessive amount, sulfide inclusions are increased and the strength of the steel sheet is deteriorated. Therefore, the amount needs to be restricted to 0.01% or less.

[Al: 0.005 to 0.15%]

Al needs to be contained in an amount of at least 0.005% or more for deoxidation. Preferably, the amount contained is 0.01% or more. However, if the amount of Al contained is too high, production cost is increased. Therefore, the amount needs to be 0.15% or less, and preferably 0.13% or less.

Preferred basic components of the DP steel sheet are as mentioned above, and the remainder is iron and inevitable impurities. Examples of inevitable impurities include, as in the case of the above TRIP steel sheet, N, O, tramp elements and the like (for example, Sn, As, Sb, etc.). Preferred ranges of N and O are the same as in the case of the TRIP steel sheet.

The metal structure of the DP steel sheet which may be used in the present invention may be any structure insofar as it is composed mainly of a mixed structure of ferrite and martensite. The fractions of ferrite and martensite in the metal structure are not particularly limited, and can be determined depending on the balance of the strength and elongation required for the steel sheet. That is, when the ferrite fraction (volume fraction) is increased, strength tends to be decreased but elongation tends to be improved; when the fraction (volume fraction) of martensite is increased, strength tends to be improved but elongation tends to be decreased. From the standpoint of ductility, these fractions are preferably as follows: ferrite is 5 to 90% by volume; martensite is 5 to 90% by volume; and the total amount of ferrite and martensite is 70% or more. Retained austenite (retained γ) may be additionally contained in an amount of 10% by volume or less as it does not deteriorate the characteristics. The metal structure of the basis steel sheet may be observed at the center of sheet in its thickness direction by using a scanning electron microscope (SEM) at a magnification of 3000 times.

The DP steel sheet which may be used in the present invention satisfies the requirements defined in the above. Its manufacturing conditions are not particularly limited, but, for example, the conditions shown below can be employed.

An example of conditions is as follows: a slab having the above-mentioned component composition is hot-rolled. The rolled sheet is wound up at 700° C. or lower, followed by pickling, if necessary. The sheet is then cold-rolled, and is subjected to soaking in a continuous galvanizing line at a temperature not lower than the Ac1 point. The sheet is then cooled at an average cooling rate of 1° C./sec. or higher.

The hot rolling may be performed according to a conventional method. In order to ensure the finishing temperature and prevent austenite grains from becoming coarse, the heating temperature may be about 1000 to 1300° C. The finishing temperature in the hot rolling may be 800 to 950° C. so that a texture which inhibits formability is not allowed to form, and the average cooling rate from the temperature after the finishing rolling to the winding starting temperature may be 30 to 120° C./sec. to inhibit the generation of pearlite.

The winding temperature is preferably 700° C. or lower. If the temperature is higher than this, scales formed on the surface of the steel sheet become thick and pickling property is deteriorated. Although the lower limit of the winding temperature is not particularly limited, if it is too low, a low temperature transformation phase is generated excessively, which makes the steel sheet too hard to reduce its cold-rolling property. Therefore, the lower limit of the winding temperature is preferably 250° C., and more preferably 400° C.

After the hot rolling, pickling, if necessary, is carried out according to a conventional method, and cold-rolling is then performed. The draft is preferably 15% or more. In order employ a draft lower than 15%, the thickness of the steel sheet needs to be reduced in the hot rolling step. Such reduction in the thickness in the hot rolling step increases the length of the steel sheet, and therefore it takes extra time for pickling, thereby lowering productivity.

After the cold rolling, The steel sheet is heated in the continuous annealing line or in a continuous galvanizing line to a temperature not lower than the Ac1 point and in the ferrite-austenite two-phase region or the austenite single-phase region and held to subject to soaking.

Although the soaking temperature maybe not lower than the Ac1 point, in order that the metal structure during heating is a mixed structure of ferrite and austenite and production of martensite is ensured to increase formability, it is preferable to conduct heat treatment at a temperature higher than the Ac1 point by about 50° C. or more. The temperature is specifically about 780° C. or more. The upper limit of the soaking temperature is not particularly limited, but is 900° C. or lower from the standpoint of preventing austenite grains from becoming coarse.

The holding time of the soaking treatment is not particularly limited either, and may be, for example, about 10 seconds. After the soaking treatment, the steel sheet may be cooled to room temperature at an average cooling rate of 1° C./sec. or higher so that a high-strength steel sheet (cold-rolled steel sheet) can be obtained. If the average cooling rate is lower than 1° C./sec., a pearlite structure is generated during cooling, and this remains as the final structure, which may cause deterioration of formability (elongation). The average cooling rate is preferably 5° C./sec. or higher. The upper limit of the average cooling rate is not particularly defined, but is preferably about 50° C./sec. considering the ease of controlling the steel sheet temperature and the costs of equipment.

To manufacture a GA steel sheet in which an alloying hot dip galvanizing plating is formed on the surface of the DP steel sheet as mentioned above, the following procedure may be employed: The steel sheet is soaked under the above conditions in a continuous hot dip galvanizing line, and is cooled to a plating bath temperature (400 to 500° C., preferably 440 to 470° C.) at an average cooling rate of 1° C./sec. or higher, followed by hot dip galvanizing. If the average cooling rate is lower than 1° C./sec., a pearlite structure is generated during cooling, and this remains as the final structure, which may cause deterioration of formability (elongation). The average cooling rate is preferably 5° C./sec. or higher. The upper limit of the average cooling rate is not particularly defined, but is preferably about 50° C./sec. considering the ease of controlling the steel sheet temperature and the costs of equipment.

The composition of the plating bath is not particularly limited, and a known hot dip galvanizing bath may be used. It is preferable that the amount of Al contained in the plating bath is 0.05 to 0.2%. Al is an element which functions to control the alloying speed of the hot dip galvanized layer. When the steel sheet is immersed into in a hot dip galvanizing bath containing Al, a Fe—Al metal layer is formed on the surface of the steel sheet (that is, the interface between the steel sheet and the hot dip galvanized layer), and therefore the steel sheet and zinc are prevented from being immediately alloyed. However, when the amount of Al is lower than 0.05%, the Fe—Al alloy layer becomes too thin. Therefore, alloying of the steel sheet and zinc is likely to immediately proceed when the steel sheet is immersed into the plating bath. Accordingly, the Γ phase grows to a great extent before alloying is completed on the surface of the plating in the alloying process step, thereby lowering powdering resistance (resistance to peeling of plating). The amount of Al contained is more preferably 0.07% or more. However, when the amount of Al contained is higher than 0.2%, the Fe—Al alloy layer becomes too thick. Therefore, alloying of Fe and Zn in the alloying process step is inhibited and alloying of the hot dip galvanized layer is delayed. Thus, to proceed alloying, there arises the necessity to elongate the alloying line or separately perform the alloying process at a high temperature. The amount of Al contained is more preferably 0.18% or less.

After the hot dip galvanizing, the steel sheet is cooled to room temperature at an average cooling rate of 1° C./sec. or higher, whereby austenite in the steel sheet is transformed into martensite and a mixed structure mainly consisting of ferrite and martensite can be obtained. If the cooling rate is lower than 1° C./sec., it is difficult to produce martensite, and pearlite and intermediate transformation structures may occur. The average cooling rate is preferably 10° C./sec. or higher.

To manufacture a hot dip galvannealed high-strength steel sheet in which an hot dip galvannealed plating is formed on the surface of the above DP steel sheet, the following procedure may be employed: the steel sheet is subjected to hot dip galvanizing under the above conditions, and is then subjected to an alloying process by heating to about 400 to 750° C. (preferably about 500° C. to 600° C.). The heating means for performing the alloying process is not particularly limited, and various commonly used methods (for example, gas heating, induction heater heating, etc.) can be used.

After the alloying process, the steel sheet is cooled to room temperature at an average cooling rate of 1° C./sec. or higher, whereby a mixed structure mainly consisting of ferrite and martensite can be obtained.

In the hot dip galvannealed steel sheet in which the composite phase steel sheet is used as the basis steel sheet as mentioned above, the tensile strength (TS) of the basis steel sheet is 590 to 1270 MPa and the balance of strength and ductility is good. Therefore, the characteristics are reflected so that the resulting hot dip galvannealed steel sheet also has a good balance of strength and ductility. The hot dip galvannealed steel sheet is thus usable as a material for various kinds of parts.

The basic components of various kinds of steel sheets (TRIP steel sheets and DP steel sheets) used as the basis steel sheet in the present invention are as mentioned above. In addition to the above-mentioned basic elements, still other elements listed below, if necessary, can be usefully contained: (a) Cr: 1% or less (not including 0%) and/or Mo: 1% or less (not including 0%), (b) one or more members selected from the group consisting of Ti: 0.2% or less (not including 0%), Nb: 0.2% or less (not including 0%) and V: 0.3% or less (not including 0%), (c) Cu: 3% or less (not including 0%) and/or Ni: 3% or less (not including 0%), (d) B: 0.01% or less (not including 0%), (e) Ca: 0.01% or less (not including 0%), among other elements. The characteristics of the basis steel sheet (that is, high-strength hot dip galvannealed steel sheet) are further improved depending on added components. Preferred ranges of these elements when they are contained and reasons for their limitation are as follows:

[Cr: 1% or less (not including 0%) and/or Mo: 1% or less (not including 0%)]

Cr and Mo are solid solution hardening elements, and effectively functions to increase the strength of the steel sheet. Such effects are enhanced as their amounts contained are increased, but the effects are saturated if they are added in excessively large amounts, which will also lead to increased costs. Therefore, the amounts of Cr and Mo are both preferably 1.0% or less (more preferably 0.5% or less).

[One or more members selected from the group consisting of Ti: 0.2% or less (not including 0%), Nb: 0.2% or less (not including 0%) and V: 0.3% or less (not including 0%)]

Ti, Nb and V are elements which form precipitates such as carbide and nitride in the steel to reinforce the steel. In particular, Ti microstructurizes crystal grains to effectively function to increase yield strength. In case of the DP steel sheet, these elements also inhibit the generation of intermediate transformation structures. However, if Ti is contained in an excessive amount, a large amount of carbide is deposited on the grain boundaries, and local elongation is thus lowered. Therefore, the amount of Ti is 0.2% or less, preferably 0.15% or less, and more preferably 0.13% or less. In the DP steel sheet, Ti dissolves in the steel in the solid state and inhibits the generation of intermediate transformation structures in the course of cooling, and also functions to enhance the balance of strength and ductility of the steel sheet.

Nb and V, as the above Ti, are the elements which microstructurize crystal grains and effectively increase strength without impairing toughness. Moreover, in case of the DP steel sheet, as the above Ti, they dissolve in the steel in the solid state and inhibit the generation of intermediate transformation structures in the course of cooling, and also function to enhance the balance of strength and ductility of the steel sheet. However, if they are contained in excessive amounts, their effects are saturated and the costs are increased. Therefore, the amount of Nb is 0.2% or less, preferably 0.15% or less, and more preferably 0.13% or less, and the amount of V is 0.3% or less, preferably 0.25% or less, and more preferably 0.2% or less. Ti, Nb and V may be contained singly or in combination.

[Cu: 3% or less (not including 0%) and/or Ni: 3% or less (not including 0%)]

Cu and Ni are both solid solution hardening elements, and function to improve the strength of the steel sheet. They also improve corrosion resistance of the steel sheet. However, if Cu is contained in an amount higher than 3.0% and Ni in an amount higher than 3.0%, their effects are saturated, and the costs are increased. Therefore, the amount of Cu is preferably 3.0% or less, more preferably 2.5% or less, and still more preferably 2.0% or less. The amount of Ni is preferably 3.0% or less, more preferably 2.5% or less, and still more preferably 2.0% or less. Cu and Ni may be used singly or in combination.

[B: 0.01% or less (not including 0%)]

B is an element which increases hardenability, and improves the strength of the steel sheet. When it is contained in the presence of Mo, hardenability during accelerated cooling after rolling is controlled to optimize the balance of strength and toughness of the steel sheet. However, when B is contained in the DP steel sheet, it hardly affects the generation of intermediate transformation structures, and thus does not affect the above-mentioned optimum amount of Si. However, if B is excessively contained, the toughness of the steel sheet is deteriorated. Therefore, the amount of B is preferably 0.01% or less, and more preferably 0.005% or less. The lower limit of the amount of B contained is not particularly limited, but is preferably 0.0005% or more.

[Ca: 0.01% or less (not including 0%)]

Ca is an element which spheroidizes sulfide in the steel and improves formability. However, if it is contained in an amount higher than 0.01%, its effect is saturated, which is economically wasteful. Therefore, the amount of Ca is preferably 0.01% or less, and more preferably 0.005% or less. The lower limit of the amount of Ca is not particularly limited, but is preferably 0.0005% or more.

EXAMPLES

The invention will be described in more detail with reference to the following examples, which are not intended to restrict the scope thereof, and appropriate changes may be made in the invention within the range covered by the gist described herein above and below. Any such changes are included in the technical range of the present invention.

Example 1

1. Manufacture of Hot Dip Galvannealed Steel Sheet (GA Steel Sheet)

GA steel sheets were produced in a CGL under the conditions shown below and at the steel sheet temperatures of the oxidizing furnace (OF) shown in Table 1.

(1) Basis steel sheet

Thickness: 1.2 mm

Composition of chemical constituents: Si: 0.3 or 1.0% by mass, C: 0.08% by mass, Mn: 2.0% by mass, P: 0.010% by mass, S: 0.003% by mass, Al: 0.04% by mass, remainder: Fe and inevitable impurities (2) Line speed: 40 m/sec.

(3) Non-oxidizing furnace (NOF)

Stationary direct flame burner

Air-fuel ratio (r1): 0.95

Residence time: 28 sec.

(4) Oxidizing furnace (OF)

Stationary direct flame burner

Air-fuel ratio (r2): 1.30

Residence time: 6 sec.

(5) Reducing furnace

Atmosphere: $N_2$-15% by volume $H_2$

Steel sheet temperature: 800 to 850° C.

Residence time: 50 sec.

(6) Plating

Composition of bath: Zn-0.10% by mass Al (Al: effective concentration)

Bath temperature: 460° C.

Temperature of entering steel sheet: 460° C.

Residence time: 3.8 sec.

(7) Alloying furnace

Direct flame heating type

Alloying furnace temperature: 850 to 1000° C.

Residence time: 20 sec.

2. Evaluation of Hot Dip Galvannealed Steel Sheet (GA Steel Sheet)

The GA steel sheets obtained in the above-mentioned manner were evaluated for the items listed below. The results are shown in Table 1.

(1) Thickness of the Region in which Al (atomic %)/Zn (atomic %)≧0.10

(ii) Evaluation scale

Amount of plating peeled: less than 4 g/m$^2$: ◎

4 g/m$^2$ or more but less than 10 g/m$^2$: ○

10 g/m$^2$ or more but less than 15 g/m$^2$: Δ

15 g/m$^2$ or more: ×

TABLE 1

| | | Steel sheet temperature in OF | | Plated layer | | | | | | |
|---|---|---|---|---|---|---|---|---|---|---|
| GA steel sheet No. | Amount of Si in steel sheet (%) *1 | Inlet temperature (° C.) *2 | Outlet temperature (° C.) *3 | Amount of plating (g/m$^2$) | Amount of Fe (%) | Thickness of Al/Zn *4 ≧ 0.10 region (Å) | Surface layer structure | Si-based oxide | Amount of Si (%) *1 | Powdering resistance |
| 1 | 1.0 | 655 | 750 | 51 | 10.2 | 300 | ζ | Found | 0.19 | ○ |
| 2 | 1.0 | 655 | 750 | 54 | 10.9 | 300 | $\delta_1$ | Found | 0.25 | ◎ |
| 3 | 1.0 | 675 | 770 | 46 | 10.5 | 400 | ζ | Found | 0.20 | ◎ |
| 4 | 1.0 | 675 | 770 | 47 | 11.9 | 400 | $\delta_1$ | Found | 0.33 | ◎ |
| 5 | 1.0 | 675 | 770 | 52 | 11.2 | 400 | $\delta_1$ | Found | 0.10 | ◎ |
| 6 | 1.0 | 725 | 810 | 46 | 12.3 | 500 | ζ | Found | 0.23 | ◎ |
| 7 | 1.0 | 725 | 810 | 52 | 12.0 | 500 | $\delta_1$ | Found | 0.43 | ◎ |
| 8 | 1.0 | 740 | 825 | 50 | 10.4 | 600 | $\delta_1$ | Found | 0.28 | ◎ |
| 9 | 1.0 | 770 | 850 | 50 | 11.1 | 800 | $\delta_1$ | Found | 0.27 | ◎ |
| 10 | 0.3 | 600 | 710 | 47 | 10.7 | 400 | ζ | Found | 0.05 | ○ |
| 11 | 0.3 | 630 | 730 | 50 | 12.0 | 450 | ζ | Found | 0.12 | ◎ |
| 12 | 0.3 | 675 | 750 | 53 | 11.5 | 600 | $\delta_1$ | Found | 0.03 | ○ |
| 13 | 1.0 | 500 | 640 | 50 | 11.0 | 150 | $\delta_1$ | Found | 0.22 | X |
| 14 | 1.0 | 500 | 640 | 48 | 10.2 | 150 | ζ | Found | 0.27 | Δ |
| 15 | 1.0 | 550 | 670 | 50 | 11.5 | 200 | $\delta_1$ | Found | 0.22 | X |
| 16 | 1.0 | 590 | 700 | 48 | 11.8 | 250 | $\delta_1$ | Found | 0.30 | Δ |

*1 Percentage by mass in the steel sheet or plated layer (% by mass)

*2 Steel sheet temperature after being carried out from NOF and before entering OF was determined by radiation thermometer

*3 Steel sheet temperature carried out from OF was determined by radiation thermometer

*4 Ratio of atoms (atomic %)

Each of the steel sheets was subjected to Ar ion etching at a rate of 50 Å/min. from the surface of the plated layer by the ESCA (electron spectroscopy for chemical analysis) method, and at the same time the atomic ratio of Al and Zn was determined at intervals of 50 Å to determine the thickness of the region in which Al (atomic %)/Zn (atomic %)≧0.10.

(2) Surface Layer of the Plated Layer

A cross section of each of the plated layers was observed to determine which phase the surface layer of the plated layer was found to be, the δ1 phase or the ζ phase, by the SEM (scanning electron microscope).

(3) Si-Based Oxide in the Plated Layer

A cross section of the plated layer was observed by the EPMA (electron probe microanalysis) to determine whether or not Si-based oxide was present in the plated layer.

(4) Amounts of Fe and Si in the Plated Layer

The amounts of Fe and Si in the plated layer were measured by the ICP (inductively coupled plasma spectrometry) by dissolving the plated layer in hydrochloric acid.

(5) Powdering Resistance

Each of the GA steel sheets was formed by hat channel drawing with bead under the conditions described below, and a tape peeling test was performed on the outer side wall of the formed article. The peeled plated layer was then dissolved in hydrochloric acid, and the amount of the plating peeled was determined by the ICP. The peeling was evaluated on the following scales.

(i) Forming conditions

Type of press: crank press

Size of sample GA: 40 mm (width)×250 mm (length)

Mold: Bead radius: 5 mm (half round bead), punch shoulder radius: 5 mm, die shoulder radius: 5 mm, forming height: 65 mm The results shown in Table 1 reveal that the GA steel sheets No. 1 to 12 (OF inlet temperature: 600° C. or higher, outlet temperature: 710° C. or higher) produced by setting the sheet temperature in the OF high so that a thick layer of the Fe-based oxide was formed each had an Al concentrated surface layer region (Al (atomic %)/Zn (atomic %)≧0.10) having a thickness of 300 Å or more formed thereon. In addition, the GA steel sheets No. 1 to 12 had powdering resistance higher than the GA steel sheet No. 13 to 16 in which the thickness of the Al concentrated surface layer region was 300 Å less than.

Example 2

In this Example, there is described that a hot dip galvannealed steel sheet which exhibits the highest possible balance of strength and ductility corresponding to the alloying temperature can be obtained by controlling Cγ before being alloyed to meet equation (1) mentioned above depending on an alloying temperature.

Table 2 below shows chemical composition of steel materials melt by a converter. These were prepared as slabs by continuous forging, heated to and held at 1150° C., hot-rolled at a finishing temperature between 800 to 900° C. and at a draft of about 99%, cooled at an average cooling rate of 50° C./sec, and were then wound up at 500° C., giving hot-rolled steel sheets having thickness of 2.4 mm. The obtained hot-rolled steel sheets were further pickled and cold-rolled, giving cold-rolled steel sheets each having a thickness of 1.6 to 2.0 mm. The obtained cold-rolled steel sheets were subjected to the process described below in a CGL, giving soaked hot dip galvannealed steel sheets.

TABLE 2

| Type of steel | Chemical components * (% by mass) | | | | | | | | | | | | | | | | |
|---|---|---|---|---|---|---|---|---|---|---|---|---|---|---|---|---|---|
| | C | Si | Mn | P | S | Al | Cr | Mo | N | B | Ca | Cu | Ni | Ti | Nb | V | Si + Al |
| A | 0.07 | 1.53 | 1.83 | 0.015 | 0.002 | 0.42 | — | — | 0.004 | — | — | — | — | — | — | — | 1.95 |
| B | 0.15 | 1.92 | 1.71 | 0.007 | 0.001 | 0.05 | — | — | 0.005 | — | — | — | — | — | — | — | 1.97 |
| C | 0.18 | 1.71 | 2.52 | 0.006 | 0.001 | 0.06 | — | — | 0.005 | — | — | — | — | — | — | — | 1.77 |
| D | 0.21 | 0.55 | 2.12 | 0.005 | 0.003 | 2.23 | — | — | 0.006 | — | — | — | — | — | — | — | 2.78 |
| E | 0.28 | 1.12 | 1.75 | 0.012 | 0.001 | 0.04 | 0.21 | — | 0.005 | — | — | — | — | 0.19 | — | 0.31 | 1.16 |
| F | 0.17 | 0.57 | 2.34 | 0.008 | 0.001 | 1.67 | — | — | 0.006 | — | — | 0.51 | 0.42 | — | — | — | 2.34 |
| G | 0.14 | 1.17 | 3.17 | 0.013 | 0.002 | 0.05 | — | 0.34 | 0.004 | — | 0.006 | — | — | — | — | — | 1.22 |
| H | 0.23 | 2.01 | 0.81 | 0.012 | 0.001 | 0.21 | 0.37 | 0.25 | 0.005 | 0.0018 | — | — | — | — | — | — | 2.22 |
| I | 0.12 | 2.83 | 2.13 | 0.016 | 0.002 | 0.05 | 0.15 | — | 0.004 | — | — | — | — | — | 0.05 | 0.15 | 2.88 |
| J | 0.15 | 1.57 | 2.47 | 0.005 | 0.002 | 0.04 | — | — | 0.005 | 0.0025 | — | 0.26 | 0.19 | 0.05 | 0.13 | — | 1.61 |
| K | 0.02 | 1.31 | 2.26 | 0.018 | 0.002 | 0.09 | — | — | 0.006 | — | — | — | — | 0.22 | — | — | 1.40 |
| L | 0.08 | 0.32 | 2.67 | 0.012 | 0.001 | 0.05 | — | — | 0.004 | 0.0017 | — | — | — | — | — | — | 0.37 |
| M | 0.11 | 3.12 | 1.22 | 0.017 | 0.002 | 0.51 | — | 0.25 | 0.004 | — | — | 0.25 | 0.21 | — | — | — | 3.63 |
| N | 0.15 | 0.73 | 3.75 | 0.011 | 0.002 | 0.04 | — | — | 0.005 | — | 0.005 | — | — | — | — | — | 0.77 |

* Remainder: iron and inevitable impurities

1. Manufacture of Hot Dip Galvannealed Steel Sheets (GA)

GA steel sheets were manufactured in a CGL under the conditions and at the steel sheet temperatures of the oxidizing furnace (OF) shown in Table 3 below.

(1) Line speed: 30 m/sec.

(2) Non-oxidizing furnace (NOF)

Stationary direct flame burner

Air-fuel ratio (r1): 0.95

Residence time: 40 sec.

(3) Oxidizing furnace (OF)

Stationary direct flame burner

Air-fuel ratio (r2): 1.30

Residence time: 8 sec.

(4) Reducing furnace

Atmosphere: $N_2$-15% by volume $H_2$

Steel sheet temperature: 800 to 900° C.

Residence time: 67 sec.

(5) Cooling zone

Austempering temperature: 350 to 450° C.

(Average cooling rate until this temperature range is reached: 15° C./sec.)

Austempering time: 45 sec.

(6) Plating bath

Composition of bath: Zn-0.10% by mass Al (Al: effective concentration)

Bath temperature: 460° C.

Temperature of entering steel sheet: 460° C.

Residence time: 5.1 sec.

(7) Alloying furnace

Direct flame heating type

Alloying furnace temperature: 450 to 550° C.

Residence time: 27 sec.

The GA steel sheets in the above-mentioned manner were evaluated for the following items in a manner similar to Example 1: (1) Thickness of the region in which Al (atomic %)/Zn (atomic %)≧0.10, (2) Surface layer of the plated layer, (3) Si-based oxide in the plated layer, (4) Amounts of Fe and Si in the plated layer, and (5) Powdering resistance [forming conditions and evaluation scales are also the same as in Example 1]. The results are shown in Table 3 below.

TABLE 3

| | | | Steel sheet temperature in OF | | Plated layer | | | | | | |
|---|---|---|---|---|---|---|---|---|---|---|---|
| GA steel sheet No. | Type of steel | Amount of Si in steel sheet (%) *1 | Inlet temperature (° C.) *2 | Outlet temperature (° C.) *3 | Amount of plating ($g/m^2$) | Amount of Fe (%) | Thickness of Al/Zn *4 ≧ 0.10 region (Å) | Surface layer structure | Si-based oxide | Amount of Si (%) *1 | Powdering resistance |
| 17 | A | 1.53 | 550 | 650 | 35 | 11.3 | 150 | $\delta_1$ | Found | 0.21 | X |
| 18 | A | | 660 | 750 | 41 | 11.8 | 350 | $\delta_1$ | Found | 0.19 | ◎ |
| 19 | B | 1.92 | 680 | 810 | 38 | 12.2 | 500 | $\delta_1$ | Found | 0.33 | ◎ |
| 20 | B | | 780 | 870 | 39 | 10.9 | 650 | $\delta_1$ | Found | 0.24 | ◎ |
| 21 | B | | 780 | 870 | 36 | 11.1 | 700 | $\delta_1$ | Found | 0.31 | ◎ |
| 22 | B | | 780 | 870 | 40 | 8.9 | 650 | $\zeta$ | Found | 0.29 | ◎ |
| 23 | B | | 780 | 870 | 40 | 11.5 | 650 | $\delta_1$ | Found | 0.29 | ◎ |
| 24 | B | | 780 | 870 | 40 | 12.5 | 650 | $\delta_1$ | Found | 0.29 | ◎ |
| 25 | B | | 780 | 870 | 41 | 10.8 | 650 | $\delta_1$ | Found | 0.28 | ◎ |
| 26 | B | | 820 | 900 | 43 | 8.4 | 800 | $\zeta$ | Found | 0.28 | ◎ |
| 27 | C | 1.71 | 760 | 880 | 40 | 10.1 | 650 | $\zeta$ | Found | 0.25 | ◎ |
| 28 | C | | 780 | 870 | 34 | 11.9 | 750 | $\delta_1$ | Found | 0.22 | ◎ |

TABLE 3-continued

| GA steel sheet No. | Type of steel | Amount of Si in steel sheet (%) *1 | Steel sheet temperature in OF: Inlet temperature (° C.) *2 | Steel sheet temperature in OF: Outlet temperature (° C.) *3 | Plated layer: Amount of plating ($g/m^2$) | Plated layer: Amount of Fe (%) | Plated layer: Thickness of Al/Zn *4 ≧ 0.10 region (Å) | Plated layer: Surface layer structure | Plated layer: Si-based oxide | Plated layer: Amount of Si (%) *1 | Powdering resistance |
|---|---|---|---|---|---|---|---|---|---|---|---|
| 29 | C | | 820 | 900 | 41 | 12.2 | 800 | $\delta_1$ | Found | 0.33 | ◎ |
| 30 | C | | 820 | 900 | 36 | 12.8 | 750 | $\delta_1$ | Found | 0.31 | ◎ |
| 31 | C | | 820 | 900 | 38 | 12.1 | 800 | $\delta_1$ | Found | 0.26 | ◎ |
| 32 | C | | 820 | 900 | 39 | 12.8 | 800 | $\delta_1$ | Found | 0.38 | ◎ |
| 33 | D | 0.55 | 740 | 830 | 42 | 12.9 | 800 | $\delta_1$ | Found | 0.34 | ◎ |
| 34 | D | | 820 | 900 | 44 | 8.3 | 700 | $\zeta$ | Found | 0.38 | ◎ |
| 35 | E | 1.12 | 550 | 650 | 41 | 13.1 | 200 | $\delta_1$ | Found | 0.19 | Δ |
| 36 | E | | 740 | 830 | 40 | 9.7 | 650 | $\zeta$ | Found | 0.27 | ◎ |
| 37 | F | 0.67 | 680 | 810 | 40 | 12.6 | 450 | $\delta_1$ | Found | 0.05 | ○ |
| 38 | F | | 760 | 850 | 38 | 11.2 | 700 | $\delta_1$ | Found | 0.18 | ◎ |
| 39 | G | 1.17 | 740 | 830 | 39 | 13.5 | 600 | $\delta_1$ | Found | 0.41 | ◎ |
| 40 | G | | 780 | 870 | 37 | 11.8 | 800 | $\delta_8$ | Found | 0.25 | ◎ |
| 41 | H | 2.01 | 530 | 700 | 36 | 10.1 | 150 | $\zeta$ | Found | 0.01 | X |
| 42 | H | | 740 | 830 | 42 | 11.5 | 550 | $\delta_8$ | Found | 0.31 | ◎ |
| 43 | I | 2.83 | 880 | 810 | 41 | 11.8 | 500 | $\delta_8$ | Found | 0.06 | ○ |
| 44 | I | | 870 | 950 | 36 | 11.4 | 900 | $\zeta$ | Found | 0.53 | ◎ |
| 45 | J | 1.57 | 740 | 830 | 39 | 11.8 | 650 | $\delta_8$ | Found | 0.18 | ◎ |
| 46 | J | | 780 | 870 | 41 | 12.2 | 800 | $\delta_8$ | Found | 0.23 | ◎ |
| 47 | K | 1.31 | 580 | 700 | 38 | 11.3 | 200 | $\delta_8$ | Found | 0.32 | X |
| 48 | K | | 760 | 850 | 36 | 12.1 | 650 | $\delta_8$ | Found | 0.31 | ◎ |
| 49 | L | 0.32 | 740 | 830 | 41 | 8.2 | 650 | $\zeta$ | Found | 0.07 | ○ |
| 50 | L | | 780 | 870 | 39 | 10.9 | 750 | $\delta_1$ | Found | 0.23 | ◎ |
| 51 | M | 3.12 | 680 | 810 | 37 | 11.6 | 600 | $\delta_1$ | Found | 0.55 | ◎ |
| 52 | M | | 870 | 950 | 40 | 13.2 | 850 | $\delta_1$ | Found | 0.41 | ◎ |
| 53 | N | 0.73 | 680 | 750 | 38 | 11.4 | 300 | $\zeta$ | Found | 0.27 | ◎ |
| 54 | N | | 740 | 830 | 39 | 12.7 | 600 | $\delta_1$ | Found | 0.33 | ◎ |

*1 Percentage by mass in the steel sheet or plated layer (% by mass)
*2 Steel sheet temperature after being carried out from NOF and before entering OF was determined by radiation thermometer
*3 Steel sheet temperature when carried out from OF was determined by radiation thermometer
*4 Ratio of atoms (atomic %)

The results shown in Table 3 reveal that in each of the GA steel sheets No. 18 to 34, 36 to 40, 42 to 46 and 48 to 54 produced by setting the steel sheet temperature in the OF high so that a thick layer of the Fe-based oxide was formed (OF inlet temperature: 600° C. or higher, outlet temperature: 710° C. or higher), an Al concentrated surface layer region (Al (atomic %)/Zn (atomic %)≧0.10) having a thickness of 300 Å or more was formed, and had powdering resistance higher than the steel sheets in which the thickness of the Al concentrated surface layer region was less than 300 Å. Moreover, it can be seen that those in which Si-based oxide was contained in the plated layer and the amount of Si contained was 0.1% or more show even higher powdering resistance.

The GA steel sheets produced in the above-mentioned manner were examined for their metal structure and mechanical properties by the method described below from the standpoint of the characteristics of their base materials (basis steel sheets). Moreover, evaluation of alloying was also conducted under the conditions described below.

[Metal Structure]

The position at a (¼) thickness of each steel sheet was corroded using nital, and was observed using a scanning electron microscope (SEM) at a magnification of 3000 times to distinguish between ferrite and/or bainitic ferrite and the second phase (retained austenite and martensite) according to the definitions provided below and determine their volume fractions.

Ferrite: Has a dark gray color in a SEM photograph, has a polygonal shape, and does not contain the second phase in itself.

Bainitic ferrite: Determined by removing the second phase from bainite structures (blocks of needle-like structures) containing the second phase in a SEM photograph. Bainitic ferrite has a dark gray color similar to ferrite, while the second phase has a light gray color in a SEM photograph.

Retained γ: Area fractions were determined by the saturation magnetization measuring method (refer to R&D Kobe Steel Technical Report Vol. 52, No. 3).

[Measurement of Cγ in the Retained Austenite]

Cγ in the retained austenite in the position at a ¼ thickness of each of the test materials obtained in the above mentioned manner was determined from the lattice constant determined by the X-ray diffraction. The detailed measurement method is described, for example, in ISIJ Int. Vol. 33, (1993), No. 7, P. 776.

[Evaluation of Alloying]

The GA steel sheets were visually observed to judge whether or not the hot dip galvanized layer therein was alloyed. More specifically, the case where glare caused by molten zinc was left on the surface was judged to be alloying failure (×), while the case where the surface was cloudy and free of glare was judged successful alloying (○).

[Measurement of Balance of Strength and Ductility]

A No. 5 test piece defined in JIS Z2201 was cut out from each of the above-mentioned Gl steel sheets or GA steel sheets, and was subjected to a tensile test (strain rate: 10 mm/sec.) to determine pull strength (TS) and elongation (EL).

The metal structures (retained γ, Cγ) before being alloyed, alloying temperature, the values of the left-hand side and right-handed side in equation (1), evaluation of alloying and austempering temperature are shown in Table 4 below. Moreover, the metal structures (F, BF, F+BF after alloying, of the retained γ volume fraction) and mechanical properties (TS, EL, TS×EL) are shown in Table 5 below.

TABLE 4

| GA steel sheet No. | Type of steel | Aus-tempering temperature (° C.) | Metal structure before alloying: Retained γ (% by volume) | Metal structure before alloying: Cγ (% by mass) | Alloying temperature Tga (° C.) | Value of left-hand side of equation (1) *5 | Value of right-hand side of equation (1) *6 | Evaluation of alloying |
|---|---|---|---|---|---|---|---|---|
| 17 | A | 350 | 5.1 | 0.83 | 500 | 0.92 | 1.22 | ○ |
| 18 | A | 410 | 7.2 | 0.94 | 525 | 0.85 | 1.15 | ○ |
| 19 | B | 380 | 9.8 | 1.21 | 525 | 0.85 | 1.15 | ○ |
| 20 | B | 360 | 6.8 | 0.69 | 500 | 0.92 | 1.22 | ○ |
| 21 | B | 390 | 10.2 | 1.01 | 500 | 0.92 | 1.22 | ○ |
| 22 | B | 410 | 12.5 | 1.18 | 450 | 1.07 | 1.37 | X |
| 23 | B | 410 | 12.5 | 1.18 | 500 | 0.92 | 1.22 | ○ |
| 24 | B | 410 | 12.5 | 1.18 | 550 | 0.77 | 1.07 | ○ |
| 25 | B | 440 | 10.5 | 1.03 | 500 | 0.92 | 1.22 | ○ |
| 26 | B | 350 | 7.1 | 0.85 | 450 | 1.07 | 1.37 | X |
| 27 | C | 380 | 11.2 | 1.15 | 475 | 1.00 | 1.30 | ○ |
| 28 | C | 410 | 11.8 | 1.19 | 500 | 0.92 | 1.22 | ○ |
| 29 | C | 350 | 5.1 | 0.82 | 525 | 0.85 | 1.15 | ○ |
| 30 | C | 380 | 12.9 | 1.09 | 525 | 0.85 | 1.15 | ○ |
| 31 | C | 410 | 13.1 | 1.21 | 525 | 0.85 | 1.15 | ○ |
| 32 | C | 440 | 10.6 | 1.02 | 525 | 0.85 | 1.15 | ○ |
| 33 | D | 410 | 11.3 | 1.21 | 550 | 0.77 | 1.07 | ○ |
| 34 | D | 350 | 7.4 | 0.96 | 450 | 1.07 | 1.37 | X |
| 35 | E | 350 | 8.8 | 0.82 | 525 | 0.85 | 1.16 | ○ |
| 36 | E | 380 | 11.2 | 1.25 | 475 | 1.00 | 1.30 | ○ |
| 37 | F | 380 | 10.7 | 1.16 | 550 | 0.77 | 1.07 | ○ |
| 38 | F | 410 | 12.5 | 1.21 | 478 | 1.00 | 1.30 | ○ |
| 39 | G | 410 | 3.8 | 1.17 | 550 | 0.77 | 1.07 | ○ |
| 40 | G | 380 | 7.9 | 1.12 | 500 | 0.92 | 1.22 | ○ |
| 41 | H | 350 | 8.2 | 0.64 | 475 | 1.00 | 1.30 | ○ |
| 42 | H | 410 | 13.1 | 1.17 | 500 | 0.92 | 1.22 | ○ |
| 43 | I | 410 | 12.4 | 1.12 | 500 | 0.92 | 1.22 | ○ |
| 44 | I | 350 | 7.1 | 0.80 | 475 | 1.00 | 1.30 | ○ |
| 45 | J | 350 | 6.1 | 0.82 | 500 | 0.92 | 1.22 | ○ |
| 46 | J | 380 | 3.3 | 0.80 | 500 | 0.92 | 1.22 | ○ |
| 47 | K | 350 | 0.0 | — | 500 | 0.92 | 1.22 | ○ |
| 48 | K | 410 | 0.0 | — | 525 | 0.85 | 1.15 | ○ |
| 49 | L | 350 | 0.0 | — | 450 | 1.07 | 1.37 | X |
| 50 | L | 380 | 0.0 | — | 475 | 1.00 | 1.30 | ○ |
| 51 | M | 410 | 3.2 | 2.25 | 600 | 0.92 | 1.22 | ○ |
| 52 | M | 440 | 6.8 | 1.52 | 500 | 0.77 | 1.07 | ○ |
| 53 | N | 380 | 2.7 | 0.55 | 475 | 1.00 | 1.30 | ○ |
| 54 | N | 410 | 3.5 | 0.41 | 525 | 0.85 | 1.15 | ○ |

*5 Value of left-hand side of equation (1) = 0.0030 × Tga + 2.42

*6 Value of right-hand side of equation (1) = −0.0030 × Tga + 2.72

TABLE 5

| GA steel sheet No. | Type of steel | Metal structure after alloying *: F (% by volume) | BF (% by volume) | F + BF (% by volume) | Retained γ (% by volume) | Mechanical properties: TS (MPa) | EL (%) | TS × EL (MPa %) |
|---|---|---|---|---|---|---|---|---|
| 17 | A | 71 | 15 | 86 | 4.8 | 656 | 35.4 | 23222 |
| 18 | A | 65 | 23 | 88 | 7.8 | 634 | 38 | 24092 |
| 19 | B | 63 | 20 | 83 | 5.2 | 842 | 29.2 | 24586 |
| 20 | B | 58 | 18 | 76 | 6.6 | 871 | 27.5 | 25953 |
| 21 | B | 58 | 20 | 78 | 9.8 | 838 | 29.4 | 24637 |
| 22 | B | 61 | 24 | 85 | 12.4 | 805 | 30.8 | 24794 |
| 23 | B | 61 | 24 | 85 | 12.1 | 819 | 30.2 | 24734 |
| 24 | B | 61 | 24 | 85 | 6.3 | 827 | 28.4 | 23487 |
| 25 | B | 62 | 21 | 83 | 10.3 | 831 | 29.7 | 24681 |
| 26 | B | 48 | 16 | 64 | 6.9 | 882 | 26.1 | 23020 |
| 27 | C | 7 | 78 | 85 | 10.8 | 995 | 21.9 | 21791 |
| 28 | C | 5 | 79 | 84 | 11.5 | 1003 | 22.1 | 22166 |
| 29 | C | 2 | 69 | 71 | 4.6 | 1092 | 18.4 | 20093 |
| 30 | C | 3 | 76 | 81 | 12.2 | 1015 | 22.7 | 23041 |
| 31 | C | 3 | 81 | 84 | 5.7 | 968 | 20.9 | 20649 |
| 32 | C | 3 | 79 | 82 | 10.1 | 1003 | 21.5 | 21565 |
| 33 | D | 55 | 27 | 82 | 5.2 | 812 | 27.8 | 22574 |
| 34 | D | 47 | 19 | 66 | 7.1 | 897 | 25.9 | 23232 |
| 35 | E | 61 | 23 | 84 | 6.3 | 821 | 28.3 | 23234 |
| 36 | E | 58 | 28 | 88 | 10.9 | 832 | 30.4 | 25293 |
| 37 | F | 14 | 63 | 77 | 6.5 | 992 | 20.3 | 20138 |
| 38 | F | 10 | 68 | 79 | 11.8 | 985 | 21.1 | 20784 |

TABLE 5-continued

| GA steel sheet No. | Type of steel | Metal structure after alloying * F (% by volume) | BF (% by volume) | F + BF (% by volume) | Retained γ (% by volume) | Mechanical properties TS (MPa) | EL (%) | TS × EL (MPa %) |
|---|---|---|---|---|---|---|---|---|
| 39 | G | 3 | 81 | 84 | 5.5 | 1213 | 13.2 | 16012 |
| 40 | G | 2 | 83 | 85 | 7.6 | 1244 | 14.6 | 18162 |
| 41 | H | 71 | 12 | 83 | 4.7 | 639 | 34.1 | 21790 |
| 42 | H | 68 | 16 | 82 | 12.6 | 612 | 39.1 | 23929 |
| 43 | I | 57 | 26 | 83 | 12.2 | 795 | 29.7 | 23612 |
| 44 | I | 46 | 21 | 67 | 6.8 | 891 | 26.2 | 23344 |
| 45 | J | 0 | 63 | 63 | 5.9 | 1354 | 12.5 | 16925 |
| 46 | J | 0 | 78 | 78 | 7.6 | 1275 | 13.3 | 16958 |
| 47 | K | 89 | 2 | 91 | 0.0 | 512 | 28.3 | 14490 |
| 48 | K | 87 | 6 | 83 | 0.0 | 534 | 27.8 | 14845 |
| 49 | L | 45 | 22 | 67 | 0.0 | 823 | 16.1 | 14896 |
| 50 | L | 38 | 35 | 73 | 0.0 | 788 | 17.2 | 13554 |
| 51 | M | 93 | 0 | 93 | 0.5 | 521 | 27.4 | 14275 |
| 52 | M | 85 | 2 | 87 | 1.2 | 547 | 30.5 | 16684 |
| 53 | N | 18 | 17 | 35 | 1.1 | 1429 | 5.6 | 8002 |
| 54 | N | 15 | 22 | 37 | 0.5 | 1383 | 6.3 | 8713 |

* F: ferrite, BS: bainitic ferrite

As can be clearly seen from these results, all of the GA steel sheets No. 17 to 46 are composite phase steel sheets (TRIP steel sheet) containing the base phase structure of ferrite and/or bainitic ferrite and the second phase structure of the retained austenite, and has good elongation (EL).

However, the steel sheets whose chemical component falls outside the range defined in the present invention (GA steel sheets No. 47 to 54) have undesirable values of strength (TS) or elongation (EL) and poor balance of strength and ductility.

The GA steel sheets No. 47 and 48 are examples of the cases where the amount of C contained is low, and sufficient strength is not ensured. The GA steel sheets No. 49 and 50 are examples of the cases where the amount of Si contained is low. In these steel sheets, no retained γ is present, and a composite structure consisting of ferrite, bainite and martensite is produced, failing to provide sufficient ductility.

In contrast, the GA steel sheets No. 51 and 52 are examples of the cases where the amount of Si contained is high. In these steel sheets, sufficient austenite fraction could not be ensured in annealing, and consequently a structure containing ferrite as the main phase is produced, which results in low strength. The GA steel sheets No. 53 and 54 are examples of the cases where the amount of Mn contained is high, wherein the martensite structure is the main phase. Their strength is high, but the amount of the retained γ is low, whereby elongation (EL) is significantly low.

Moreover, it can be seen that among the above GA steel sheets No. 17 to 46, those in which the total amount of ferrite and/or bainitic ferrite is 70% by volume or more and those in which the amount of the retained γ is 5% by volume or more show better elongation (EL). Further, it can be seen that in such a type of steel where the carbon concentration Cγ in the retained γ is controlled relative to the temperature of the alloying process so that the aforementioned equation (1) is met, the amount of the retained γ which is present after the alloying process is high, and its elongation (EL) is further improved.

Figure 2:
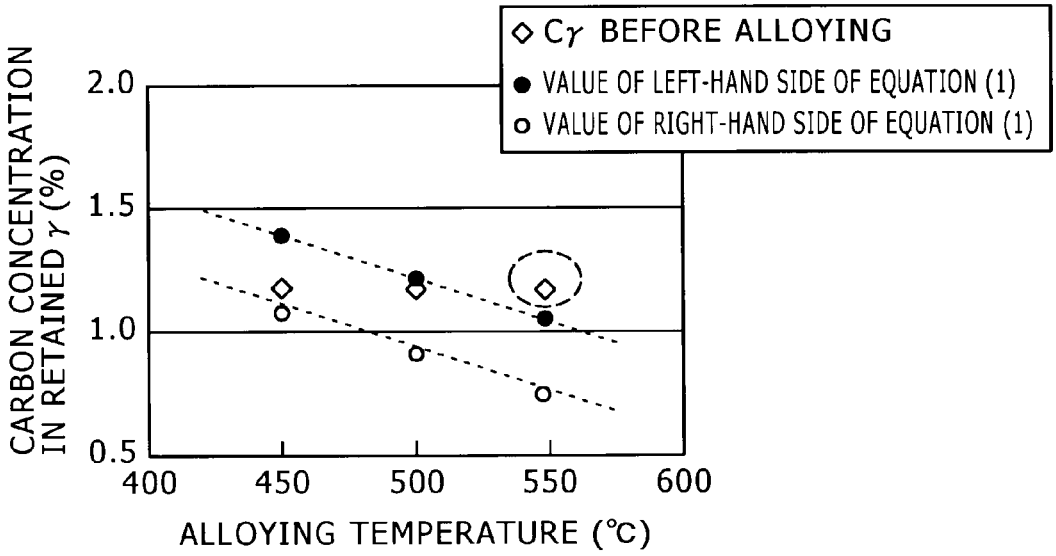
FIG. 2 is a graph showing the influence of the temperature of alloy in alloying exerted on the carbon concentration Cγ in the retained γ based on the results of GA steel sheets No. 22 to 24.
Figure 3:
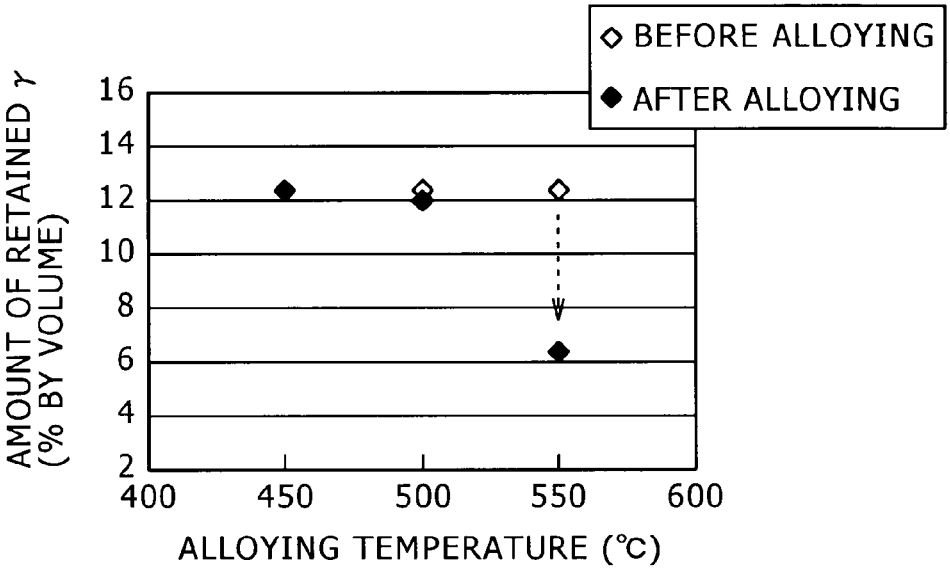
FIG. 3 is a graph showing the influence of the temperature of alloy in alloying exerted on the amount of the retained γ based on the results of the GA steel sheets No. 22 to 24.
Figure 4:
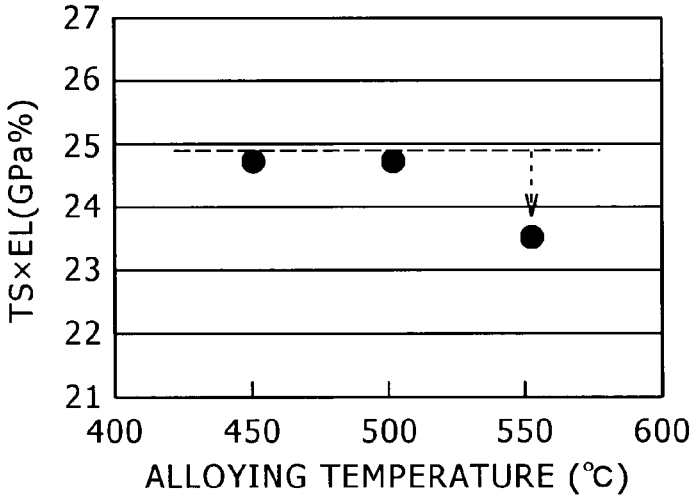
FIG. 4 is a graph showing the influence of the temperature of alloy in alloying exerted on the balance of strength and ductility (TS×EL) based on the results of the GA steel sheets No. 22 to 24.

Based on the results of GA steel sheets No. 22 to 24, the influence of the temperature of alloy in alloying on the carbon concentration Cγ in the retained γ is shown in FIG. 2; the influence of the temperature of alloy in alloying on the amount of the retained γ is shown in FIG. 3; and the influence of the temperature of alloy in alloying on the balance of strength and ductility (TS×EL) is shown in FIG. 4. These results support the above-mentioned phenomenon.

However, it can be also seen that when the temperature in the alloying process is low (alloying process temperature: 450° C. or lower), the amount of Fe in the plated layer is low and alloying of the molten zinc plating is not proceeded.

Example 3

Table 6 below shows chemical composition of steel materials melt by a converter. These were prepared as slabs by continuous forging, heated to and held at 1250° C., hot-rolled at a finishing temperature of 900° C. and a draft of about 99%, cooled at an average cooling rate of 50° C./sec, and were then wound up at 500° C., giving hot-rolled steel sheets each having a thickness of 2.4 mm. The obtained hot-rolled steel sheets were further pickled and cold-rolled, giving cold-rolled steel sheets each having a thickness of 1.6 mm. The obtained cold-rolled steel sheets were subjected to the process described below in a CGL, giving soaked hot dip galvannealed steel sheets.

TABLE 6

| Type of steel | Chemical components * (% by mass) C | Si | Mn | P | S | Al | Cr | Mo | N | B | Ca | Cu | Ni | Ti | Na | V |
|---|---|---|---|---|---|---|---|---|---|---|---|---|---|---|---|---|
| A1 | 0.063 | 0.53 | 2.12 | 0.011 | 0.001 | 0.04 | — | — | 0.005 | — | — | — | — | — | — | — |
| B1 | 0.085 | 1.19 | 2.31 | 0.016 | 0.001 | 0.05 | — | — | 0.005 | — | — | — | — | — | — | — |
| C1 | 0.099 | 1.91 | 2.22 | 0.023 | 0.002 | 0.06 | — | — | 0.004 | — | — | — | — | — | — | — |
| D1 | 0.133 | 1.65 | 2.82 | 0.016 | 0.001 | 0.05 | — | — | 0.006 | — | — | — | — | — | — | — |
| E1 | 0.095 | 1.71 | 1.75 | 0.017 | 0.002 | 0.04 | 0.21 | — | 0.004 | — | — | — | — | 0.05 | — | — |
| F1 | 0.043 | 1.26 | 2.14 | 0.012 | 0.003 | 0.08 | 0.15 | 0.07 | 0.004 | 0.0021 | 0.004 | 0.22 | 0.16 | — | — | — |
| G1 | 0.083 | 1.17 | 1.97 | 0.013 | 0.001 | 0.05 | 0.08 | — | 0.005 | — | — | — | — | — | — | — |

TABLE 6-continued

| Type of steel | Chemical components * (% by mass) | | | | | | | | | | | | | | | |
|---|---|---|---|---|---|---|---|---|---|---|---|---|---|---|---|---|
| | C | Si | Mn | P | S | Al | Cr | Mo | N | B | Ca | Cu | Ni | Ti | Na | V |
| H1 | 0.178 | 1.41 | 1.93 | 0.011 | 0.002 | 0.21 | 0.02 | 0.05 | 0.006 | — | — | 0.31 | 0.32 | — | 0.12 | — |
| I1 | 0.151 | 2.88 | 1.33 | 0.017 | 0.001 | 0.07 | — | 0.02 | 0.005 | 0.0013 | 0.003 | — | — | — | — | — |
| J1 | 0.091 | 1.67 | 1.92 | 0.021 | 0.002 | 0.11 | 0.18 | 0.22 | 0.005 | 0.0005 | — | — | — | 0.11 | — | 0.18 |
| K1 | 0.024 | 1.23 | 2.76 | 0.021 | 0.001 | 0.09 | — | — | 0.004 | — | — | — | — | 0.22 | — | — |
| L1 | 0.067 | 3.15 | 1.69 | 0.014 | 0.002 | 0.05 | — | — | 0.005 | — | — | 0.31 | 0.15 | — | — | — |
| M1 | 0.127 | 1.54 | 0.24 | 0.011 | 0.001 | 0.07 | 0.25 | — | 0.004 | 0.0014 | — | — | — | — | — | — |
| N1 | 0.088 | 0.83 | 3.24 | 0.012 | 0.002 | 0.05 | — | — | 0.008 | — | 0.007 | — | — | — | — | — |

* Remainder: iron and inevitable impurities

1. Manufacture of Hot Dip Galvannealed Steel Sheet (GA Steel Sheet)

GA steel sheets were manufactured in a CGL under the conditions shown below and at the steel sheet temperatures of the oxidizing furnace (OF) shown in Table 2.

(1) Line speed: 40 m/sec.

(2) Non-oxidizing furnace (NOF)

Stationary direct flame burner

Air-fuel ratio (r1): 0.95

Residence time: 28 sec.

(3) Oxidizing furnace (OF)

Stationary direct flame burner

Air-fuel ratio (r2): 1.30

Residence time: 6 sec.

(4) Reducing furnace

Atmosphere: $N_2$-15% by volume $H_2$

Steel sheet temperature: 800 to 900° C.

Residence time: 50 sec.

(5) Plating bath

Composition of bath: Zn-0.10% by mass Al (Al: effective concentration)

Bath temperature: 460° C.

Temperature of entering steel sheet: 460° C.

Residence time: 3.8 sec.

(6) Alloying furnace

Direct flame heating type

Alloying furnace temperature: 850 to 1100° C.

Residence time: 20 sec.

2. Evaluation of Hot Dip Galvannealed Steel Sheets (GA)

The GA steel sheets obtained in the above-mentioned manner were evaluated for the items listed below:

(1) Thickness of the Region in which Al (atomic %)/Zn (atomic %)≧0.10

The steel sheets were subjected to Ar ion etching at a rate of 50 Å/min. from the surface of the plated layer by the ESCA (electron spectroscopy for chemical analysis) method, and at the same time the atomic ratio of Al and Zn was determined at intervals of 50 Å to determine the thickness of the region in which Al (atomic %)/Zn (atomic %)≧0.10.

(2) Surface Layer of the Plated Layer

A cross section of each of the plated layers was observed to determine which phase the surface layer of the plated layer was found to be, the δ1 phase or the ζ phase, by the SEM (scanning electron microscope).

(3) Si-Based Oxide in the Plated Layer

A cross section of the plated layer was observed by the EPMA (electron probe microanalysis) to determine whether or not Si-based oxide was present in the plated layer.

(4) Amounts of Fe and Si in the Plated Layer

The amounts of Fe and Si in the plated layer were measured by the ICP (inductively coupled plasma spectrometry) by dissolving the plated layer in hydrochloric acid.

(5) Powdering Resistance

The GA steel sheets were formed by hat channel drawing with bead under the conditions similar to those in Example 1, and a tape peeling test was performed on the outer side walls of the formed articles. Subsequently, the peeled plated layer was dissolved in hydrochloric acid, and the amounts of plating peeled were determined. The determined amounts were evaluated on the same evaluation scale as in Example 1.

The results of these are shown in Table 7 below, along with the amounts of Si contained in the basis steel sheet and the steel sheet temperatures (inlet temperatures, outlet temperatures) in the OF.

TABLE 7

| GA steel sheet No. | Type of steel | Amount of Si in steel sheet (%) *1 | Steel sheet temperature in OF: Inlet temperature (° C.) *2 | Steel sheet temperature in OF: Outlet temperature (° C.) *3 | Plated layer: Amount of plating (g/m²) | Amount of Fe (%) | Thickness of Al/Zn *4 ≧ 0.10 region (Å) | Surface layer structure | Si-based oxide | Amount of Si (%) *1 | Powdering resistance |
|---|---|---|---|---|---|---|---|---|---|---|---|
| 55 | A1 | 0.63 | 655 | 750 | 53 | 11.1 | 300 | $\delta_1$ | Found | 0.11 | ◎ |
| 56 | A1 | | 740 | 830 | 51 | 10.7 | 500 | $\delta_1$ | Found | 0.05 | ○ |
| 57 | B1 | 1.19 | 550 | 650 | 52 | 11.0 | 150 | $\delta_1$ | Found | 0.31 | X |

TABLE 7-continued

| GA steel sheet No. | Type of steel | Amount of Si in steel sheet (%) *1 | Steel sheet temperature in OF: Inlet temperature (° C.) *2 | Steel sheet temperature in OF: Outlet temperature (° C.) *3 | Plated layer: Amount of plating (g/m²) | Plated layer: Amount of Fe (%) | Plated layer: Thickness of Al/Zn *4 ≧ 0.10 region (Å) | Plated layer: Surface layer structure | Plated layer: Si-based oxide | Plated layer: Amount of Si (%) *1 | Powdering resistance |
|---|---|---|---|---|---|---|---|---|---|---|---|
| 58 | B1 | | 850 | 900 | 50 | 12.0 | 800 | $\delta_1$ | Found | 0.22 | ◎ |
| 59 | C1 | 1.91 | 760 | 850 | 47 | 11.5 | 700 | $\delta_1$ | Found | 0.45 | ◎ |
| 60 | C1 | | 780 | 870 | 52 | 10.2 | 750 | $\zeta$ | Found | 0.41 | ◎ |
| 61 | D1 | 1.85 | 740 | 830 | 53 | 11.5 | 600 | $\delta_1$ | Found | 0.36 | ◎ |
| 62 | D1 | | 780 | 870 | 48 | 11.8 | 700 | $\delta_1$ | Found | 0.39 | ◎ |
| 63 | E1 | 1.71 | 760 | 850 | 48 | 10.9 | 700 | $\delta_1$ | Found | 0.31 | ◎ |
| 64 | E1 | | 880 | 930 | 51 | 10.5 | 850 | $\zeta$ | Found | 0.42 | ◎ |
| 65 | F1 | 1.26 | 760 | 850 | 49 | 11.3 | 700 | $\delta_1$ | Found | 0.29 | ◎ |
| 66 | F1 | | 780 | 870 | 52 | 11.9 | 750 | $\delta_1$ | Found | 0.27 | ◎ |
| 67 | G1 | 1.17 | 680 | 810 | 48 | 12.2 | 600 | $\delta_1$ | Found | 0.16 | ◎ |
| 68 | G1 | | 780 | 870 | 50 | 11.1 | 700 | $\delta_1$ | Found | 0.18 | ◎ |
| 69 | H1 | 1.41 | 550 | 850 | 50 | 10.3 | 150 | $\zeta$ | Found | 0.23 | X |
| 70 | H1 | | 760 | 850 | 49 | 11.9 | 750 | $\delta_1$ | Found | 0.07 | ○ |
| 71 | I1 | 2.68 | 590 | 700 | 48 | 11.5 | 200 | $\delta_1$ | Found | 0.44 | Δ |
| 72 | I1 | | 870 | 950 | 54 | 11.2 | 900 | $\delta_1$ | Found | 0.51 | ◎ |
| 73 | J1 | 1.67 | 760 | 850 | 51 | 11.7 | 750 | $\delta_1$ | Found | 0.31 | ◎ |
| 74 | J1 | | 780 | 870 | 52 | 11.1 | 800 | $\delta_1$ | Found | 0.38 | ◎ |
| 75 | K1 | 1.23 | 760 | 850 | 51 | 11.8 | 700 | $\delta_1$ | Found | 0.28 | ◎ |
| 76 | K1 | | 780 | 870 | 52 | 11.0 | 800 | $\delta_1$ | Found | 0.25 | ◎ |
| 77 | L1 | 3.15 | 850 | 910 | 50 | 10.3 | 850 | $\zeta$ | Found | 0.53 | ◎ |
| 78 | L1 | | 870 | 950 | 50 | 11.2 | 900 | $\delta_1$ | Found | 0.61 | ◎ |
| 79 | M1 | 1.54 | 760 | 850 | 48 | 10.1 | 700 | $\zeta$ | Found | 0.27 | ◎ |
| 80 | M1 | | 850 | 910 | 50 | 10.9 | 800 | $\delta_1$ | Found | 0.32 | ◎ |
| 81 | N1 | 0.63 | 550 | 650 | 49 | 10.2 | 200 | $\zeta$ | Found | 0.19 | X |
| 82 | N1 | | 740 | 830 | 52 | 11.9 | 650 | $\delta_1$ | Found | 0.07 | ○ |

The results shown in Table 7 reveal that the GA steel sheets No. 55, 56, 58 to 68, 70, 72 to 80 and 82 (OF inlet temperature: 600° C. or higher, outlet temperature: 710° C. or higher) produced by setting the steel sheet temperature in the OF high so that a thick layer of the Fe-based oxide was formed each had an Al concentrated surface layer region (Al (atomic %)/Zn (atomic %)≧0.10) having a thickness of 300 Å or more formed thereon, and had powdering resistance higher than those in which the thickness of the Al concentrated surface layer region was less than 300 Å. Moreover, the results also reveal that the steel sheets in which Si-based oxide was contained in the plated layer and the amount of Si contained was 0.1% or more show even higher powdering resistance.

From the standpoint of the characteristics of the base material (basis steel sheet), the GA steel sheets produced in the above-mentioned manner were examined for their metal structure and mechanical properties by the method described below.

[Metal Structure]

A central portion of each steel sheet in the direction of its thickness was observed using a scanning electron microscope (SEM) at a magnification of 3000 times to determine the volume fractions of ferrite (F: meaning polygonal ferrite) and martensite (M). As for the amount of the retained γ, its volume fraction was determined by the saturation magnetization measuring method (refer to R&D Kobe Steel Technical Report Vol. 52, No. 3).

[Mechanical Characteristics]

A No. 5 test piece defined in JIS Z2201 was cut out from each of the above GA steel sheets, and was subjected to a tensile test (strain rate: 10 mm/sec.) to determine the pull strength (TS), elongation (EL) and the balance of strength and ductility (TS×EL) thereof. The evaluation scale of elongation (EL) at this time is as follows:

[Evaluation Scale of Elongation]

(a) 590 MPa class (590 MPa≦TS<780 MPa): EL≧28%

(b) 780 MPa class (780 MPa≦TS<980 MPa): EL≧20%

(c) 980 MPa class (980 MPa≦TS<1180 MPa): EL≧15%

(d) 1180 MPa class (1180 MPa≦TS<1270 MPa): EL≧9%

The results of these are shown in Table 8 below, along with the appropriate ranges of equation (2) or equation (3) and the amounts of Si contained in the steel sheets.

TABLE 8

| GA steel sheet No. | Type of steel | Metal structure: F (% by volume) | Metal structure: M (% by volume) | Metal structure: F + M (% by volume) | Metal structure: Retained γ (% by volume) | Amount of Si added: Range of equation (2) or (3) | Amount of Si in steel sheet (%) * | Mechanical properties: TS (MPa) | Mechanical properties: EL (%) | Mechanical properties: TS × EL (MPa %) |
|---|---|---|---|---|---|---|---|---|---|---|
| 55 | A1 | 58 | 15 | 73 | — | — | 0.63 | 632 | 30.2 | 19086 |
| 56 | A1 | 52 | 12 | 64 | — | | | 635 | 29.2 | 18542 |
| 57 | B1 | 44 | 38 | 82 | 3 | — | 1.19 | 876 | 20.1 | 17651 |
| 58 | B1 | 51 | 35 | 86 | — | | | 829 | 20.3 | 16870 |
| 59 | C1 | 27 | 53 | 80 | 4 | — | 1.91 | 1008 | 16.9 | 17035 |
| 60 | C1 | 21 | 44 | 65 | 1 | | | 997 | 17.1 | 17049 |
| 61 | D1 | 22 | 69 | 91 | 5 | — | 1.85 | 1221 | 11.1 | 13553 |

TABLE 8-continued

| GA steel sheet No. | Type of steel | Metal structure F (% by volume) | M (% by volume) | F + M (% by volume) | Retained γ (% by volume) | Amount of Si added Range of equation (2) or (3) | Amount of Si in steel sheet (%) * | Mechanical properties TS (MPa) | EL (%) | TS × EL (MPa %) |
|---|---|---|---|---|---|---|---|---|---|---|
| 62 | D1 | 18 | 58 | 76 | 4 | | | 1198 | 10.8 | 12938 |
| 63 | E1 | 35 | 52 | 87 | 4 | — | 1.71 | 1047 | 16.6 | 17346 |
| 64 | E1 | 29 | 55 | 84 | 2 | | | 1016 | 17.1 | 17340 |
| 65 | F1 | 48 | 41 | 89 | 1 | 0.51~2.21 | 1.26 | 850 | 21.5 | 18298 |
| 66 | F1 | 45 | 38 | 83 | — | | | 834 | 21.3 | 17787 |
| 67 | G1 | 57 | 27 | 84 | 2 | — | 1.17 | 638 | 29.8 | 18966 |
| 68 | G1 | 53 | 15 | 68 | — | | | 620 | 29.6 | 18306 |
| 69 | H1 | 34 | 53 | 87 | 5 | 0.89~2.59 | 1.41 | 1230 | 12.6 | 15547 |
| 70 | H1 | 27 | 51 | 78 | 1 | | | 1208 | 13.3 | 16115 |
| 71 | I1 | 41 | 43 | 84 | 6 | — | 2.68 | 805 | 20.7 | 16664 |
| 72 | I1 | 27 | 46 | 73 | 2 | | | 782 | 20.2 | 15796 |
| 73 | J1 | 31 | 55 | 86 | 4 | 0.89~2.59 | 1.67 | 1032 | 19.4 | 20021 |
| 74 | J1 | 33 | 58 | 91 | 2 | | | 1036 | 18.6 | 19260 |
| 75 | K1 | 81 | 6 | 87 | — | — | 1.23 | 497 | 28.8 | 14274 |
| 76 | K1 | 86 | 10 | 96 | — | | | 514 | 28.2 | 14455 |
| 77 | L1 | 91 | 5 | 96 | — | — | 3.15 | 517 | 28.3 | 14605 |
| 78 | L1 | 94 | 3 | 97 | — | | | 505 | 28.7 | 14468 |
| 79 | M1 | 58 | 7 | 65 | — | — | 1.54 | 559 | 27.0 | 15065 |
| 80 | M1 | 41 | 10 | 51 | — | | | 584 | 27.9 | 16264 |
| 81 | N1 | 23 | 65 | 88 | — | — | 0.63 | 1232 | 6.5 | 7943 |
| 82 | N1 | 21 | 68 | 89 | — | | | 1137 | 8.7 | 9831 |

* percentage by mass in steel sheet (% by mass)

As can be clearly seen from Table 8, all of the GA steel sheets No. 55 to 74 were constituted by a composite structure mainly consisting of ferrite and martensite, and had good elongation (EL).

However, the steel sheets whose chemical component falls outside the range defined in the present invention (GA steel sheets No. 75 to 82) had low values of either strength (TS) or elongation (EL), and had poor balance of strength and ductility (TS×EL).

The GA steel sheets No. 75 and 76 are examples of the cases where the amount of C contained is low, and sufficient strength is not ensured. The GA steel sheets No. 77 and 78 are examples of the cases where the amount of Si contained is high. The ferrite fraction in these steel sheets is too high so that sufficient strength is not obtained.

The GA steel sheets No. 79 and 80 are examples of the cases where the amount of Mn contained is low. Too low an amount of Mn solid solution lowers the strength of these steel sheets. The GA steel sheets No. 81 and 82 are examples of the cases where the amount of Mn contained is high. The strength is sufficiently high, but elongation (EL) is significantly low in these steel sheets.

Moreover, it is shown that among the above GA steel sheets No. 55 to 74, those in which the total amount of ferrite and martensite was 70% by volume or more had better elongation (EL). It is further shown that the steel sheets in which the amount of Si contained satisfied the appropriate range of the aforementioned equation (1) or (2) had further improved elongation (EL).

Industrial Applicability

In hot dip galvannealing, a Zn plating bath containing Al in an amount of about 0.1% by mass is normally used. Therefore, Al is contained in the formed plated layer. Al in this plated layer tends to concentrate on the surface layer as oxide in the course of solidification of the plated layer. This Al-based oxide exists on the surface layer of the plated layer in a thickness of about 100 to 200 Å in a normal GA steel sheet, and the greater the depth from the surface layer, the less the concentration of Al.

The inventors of the present invention have focused on this Al-based oxide, and conducted extensive research on the relationship between Al-based oxide and the characteristics of the plated layer. As a result, they found that powdering resistance can be improved by providing a region containing a certain amount or more of Al-based oxide thickly on the surface layer of the plated layer. Hence, they succeeded in obtaining a hot dip galvannealed steel sheet having excellent powdering resistance by providing the region in which Al (atomic %)/Zn (atomic %)≧0.10 (hereinafter sometimes abbreviated as "Al concentrated surface layer region".) on the surface layer in a thickness of 300 Å or more from the surface of the plated layer along the depth direction of the plated layer.

Furthermore, when a specific TRIP steel sheet and DP steel sheet is used as the basis steel sheet in alloying a hot dip galvanized steel sheet to produce a hot dip galvannealed steel sheet, the excellent function to improve ductility of the basis steel sheet is effectively inherited as it is after alloying. As a result, a hot dip galvannealed steel sheet which can exhibit the highest possible balance of strength and ductility depending on an alloying temperature can be produced.

The invention claimed is:

1. A high-strength hot dip galvannealed steel sheet having high powdering resistance, wherein the hot dip galvannealed steel sheet has a Fe—Zn alloy plated layer on at least one side of a basis steel sheet, and the Fe—Zn alloy plated layer comprises a region, further incorporated with Al, which has a ratio of Al atom %/Zn atom %≧0.10, and the region is present along the depth direction of the plated layer from the surface to a depth of 300 Å or more, wherein the plated layer comprises a Si-based oxide and an amount of Si in the plated layer is 0.1 mass % or more.

2. The high-strength hot dip galvannealed steel sheet according to claim 1, wherein the amount of Si in the basis steel sheet is from 0.3 to 3.0 mass %.

3. The high-strength hot dip galvannealed steel sheet according to claim 1, wherein the basis steel sheet comprises from 0.05 to 0.3 mass % of C; from 0.5 to 3.0 mass % of Si; from 0.5 to 3.5 mass % of Mn; 0.03 mass % or less, not including 0 mass %, of P; 0.01 mass % or less, not including 0 mass %, of S; and from 0.005 to 2.5 mass % of Al; wherein Si+Al is from 0.6 to 3.5 mass %; and the basis steel sheet further comprises iron and inevitable impurities as the remainder; and has a steel structure of a composite phase steel sheet comprising a base phase structure consisting of at least one of ferrite and bainitic ferrite and a second phase structure of retained austenite.

4. The high-strength hot dip galvannealed steel sheet according to claim 3, wherein the basis steel sheet comprises at least one of 1 mass % or less, not including 0 mass %, of Cr, and 1 mass % or less, not including 0 mass %, of Mo, as other elements.

5. The high-strength hot dip galvannealed steel sheet according to claim 3, wherein the basis steel sheet comprises at least one member selected from the group consisting of 0.2 mass % or less, not including 0 mass %, of Ti; 0.2 mass % or less, not including 0 mass %, of Nb; and 0.3 mass % or less, not including 0 mass %, of V, as other elements.

6. The high-strength hot dip galvannealed steel sheet according to claim 3, wherein the basis steel sheet comprises at least one of 3 mass % or less, not including 0 mass %, of Cu, and 3 mass % or less, not including 0 mass %, of Ni, as other elements.

7. The high-strength hot dip galvannealed steel sheet according to claim 3, wherein the basis steel sheet comprises 0.01 mass % or less, not including 0 mass %, of B, as another element.

8. The high-strength hot dip galvannealed steel sheet according to claim 3, wherein the basis steel sheet comprises 0.01 mass % or less, not including 0 mass %, of Ca, as another element.

9. The high-strength hot dip galvannealed steel sheet according to claim 3, wherein a steel structure in the basis steel sheet is a composite structure comprising 90% by volume or less of ferrite and 90% by volume or less of bainitic ferrite, wherein the total of ferrite and bainitic ferrite is 70% by volume or more, and an amount of retained austenite is 5% by volume or more.

10. The high-strength hot dip galvannealed steel sheet according to claim 1, wherein the basis steel sheet comprises from 0.05 to 0.3 mass % of C; from 0.5 to 3.0 mass % of Si; from 1.0 to 3.0 mass % of Mn; 0.03 mass % or less, not including 0 mass %, of P; 0.01 mass % or less, not including 0 mass %, of S; and from 0.005 to 2.0 mass % of Al; and the basis steel sheet further comprises iron and inevitable impurities as the remainder; and has a metal structure of a composite phase steel sheet comprised of a mixed structure of ferrite and martensite.

11. The high-strength hot dip galvannealed steel sheet according to claim 10, wherein the basis steel sheet comprises 1 mass % or less, not including 0 mass %, of Cr, and 1 mass % or less, not including 0 mass %, of Mo, as other elements.

12. The high-strength hot dip galvannealed steel sheet according to claim 11, wherein the amount of Si contained in the basis steel sheet satisfies the equation (2) below:

$$\alpha-4.1 \leqq [Si] \leqq \alpha-2.4 \qquad \text{b 2),}$$

wherein $$\alpha=6.9\times([C]+[Mn]/6+[Cr]/5+[Mo]/4)^{1/2},$$

wherein [ ] represents mass % of each element contained in the basis steel sheet.

13. The high-strength hot dip galvannealed steel sheet according to claim 12, wherein the basis steel sheet comprises at least one member selected from the group consisting of 0.2 mass % or less, not including 0 mass %, of Ti; 0.2 mass % or less, not including 0 mass %, of Nb; and 0.3 mass % or less, not including 0 mass %, of V; as other elements.

14. The high-strength hot dip galvannealed steel sheet according to claim 10, wherein the basis steel sheet comprises at least one member selected from the group consisting of 1 mass % or less, not including 0 mass %, of Cr; 1 mass % or less, not including 0 mass %, of Mo; 0.2 mass % or less, not including 0 mass %, of Ti; 0.2 mass % or less, not including 0 mass %, of Nb; and 0.3 mass % or less, not including 0 mass %, of V, as other elements, and the amount of Si contained in the basis steel sheet satisfies the equation (3) below:

$$\beta-4.1 \leqq [Si] \leqq \beta-2.4 \text{ [[ . . . ]]} \qquad (3),$$

wherein $$\beta=6.9\times([C]+[Mn]/6+[Cr]/5+[Mo]/4+[Ti]/15+[Nb]/17+[V]/144)^{1/2},$$

wherein [ ] represents mass % of each element contained in the steel sheet.

15. The high-strength hot dip galvannealed steel sheet according to claim 10, wherein the basis steel sheet comprises at least one of 3 mass % or less, not including 0 mass %, of Cu, and 3 mass % or less, not including 0 mass %, of Ni, as other elements.

16. The high-strength hot dip galvannealed steel sheet according to claim 10, wherein the basis steel sheet comprises 0.01 mass % or less, not including 0 mass %, of B, as another element.

17. The high-strength hot dip galvannealed steel sheet according to claim 10, wherein the basis steel sheet comprises 0.01 mass % or less, not including 0 mass %, of Ca, as another element.

18. The high-strength hot dip galvannealed steel sheet according to claim 10, wherein a metal structure of the basis steel sheet is a composite structure comprising from 5 to 90% by volume of ferrite, from 5 to 90% by volume of martensite, wherein the total amount of ferrite and martensite is 70% by volume or more, and an amount of retained austenite is 10% by volume or less.

19. The high-strength hot dip galvannealed steel sheet according to claim 10, wherein the depth is from 300 Å to 800 Å.

20. A method of manufacturing a high-strength hot dip galvannealed steel sheet according to claim 1, the method comprising:

heating in a pre-heating apparatus and in a non-oxidizing furnace a basis steel sheet;

blowing flame onto the steel sheet in an oxidizing furnace, thereby forming a Fe-based oxide layer;

subjecting the Fe-based oxide layer to reduction in a reducing annealing furnace, thereby obtaining a porous Fe layer;

cooling the steel sheet and immersing in a Zn plating bath, thereby producing a hot dip galvanized steel sheet; and heating the hot dip galvanized steel sheet in an alloying furnace, thereby producing the hot dip galvannealed steel sheet, wherein a carbon concentration Cγ in the retained austenite in the hot dip galvanized steel sheet before being alloyed is controlled to satisfy the equation (1) depending on an alloying temperature:

$$-0.0030\times Tga+2.42 \leqq C\gamma \leqq -0.0030\times Tga+2.72 \quad (1);$$

wherein 450≦Tga≦550, Tga represents an alloying temperature, and Cγ represents the carbon concentration in the retained austenite in mass in the hot dip galvanized steel sheet before being alloyed;

wherein the basis steel sheet comprises from 0.05 to 0.3 mass % of C;

from 0.5 to 3.0 mass % of Si; from 0.5 to 3.5 mass % of Mn; 0.03 mass % or less, not including 0 mass %, of P; 0.01 mass % or less, not including 0 mass %, of S; and from 0.005 to 2.5 mass % of Al, wherein Si+Al is from 0.6 to 3.5 mass %;

wherein the basis steel sheet further comprises iron and inevitable impurities as the remainder; and wherein the basis steel sheet has a steel structure of a composite phase steel sheet comprising a base phase structure consisting of at least one of ferrite and bainitic ferrite and a second phase structure of retained austenite.

* * * * *